US008085118B2

(12) United States Patent
Yu et al.

(10) Patent No.: US 8,085,118 B2
(45) Date of Patent: Dec. 27, 2011

(54) INLINE CROSS-COUPLED COAXIAL CAVITY FILTER

(75) Inventors: Ming Yu, Waterloo (CA); Ying Wang, Waterloo (CA)

(73) Assignee: COM DEV International Ltd., Cambridge (CA)

( * ) Notice: Subject to any disclaimer, the term of this patent is extended or adjusted under 35 U.S.C. 154(b) by 208 days.

(21) Appl. No.: 12/533,488

(22) Filed: Jul. 31, 2009

(65) Prior Publication Data

US 2011/0025433 A1 Feb. 3, 2011

(51) Int. Cl.
*H01P 1/202* (2006.01)
*H01P 1/205* (2006.01)

(52) U.S. Cl. ..... 333/203; 333/206; 333/207

(58) Field of Classification Search ..... 333/202, 333/203, 206, 207, 212
See application file for complete search history.

(56) References Cited

U.S. PATENT DOCUMENTS

| | | | | |
|---|---|---|---|---|
| 4,642,591 | A * | 2/1987 | Kobayashi | 333/227 |
| 5,012,210 | A * | 4/1991 | Marconi et al. | 333/209 |
| 5,495,216 | A * | 2/1996 | Jachowski | 333/208 |
| 5,608,363 | A | 3/1997 | Cameron et al. | |
| 5,812,036 | A * | 9/1998 | Estrada | 333/202 |
| 6,861,928 | B2 * | 3/2005 | Okazaki et al. | 333/202 |
| 7,057,480 | B2 * | 6/2006 | Pance et al. | 333/203 |
| 7,777,593 | B2 * | 8/2010 | Weitzenberger | 333/134 |
| 2003/0197577 | A1 | 10/2003 | Hershtig | |
| 2007/0296529 | A1 | 12/2007 | Zhang et al. | |

FOREIGN PATENT DOCUMENTS

| | | | |
|---|---|---|---|
| EP | 1174944 | A2 | 1/2002 |
| WO | 2005045985 | A1 | 5/2005 |

OTHER PUBLICATIONS

European Search Report dated Nov. 11, 2010, corresponding to Application No. 10171274.3.

R.J. Cameron, General Coupling Matrix Synthesis Methods for Chebyshev Filtering Functions, IEEE Transactions on Microwave Theory and Techniques, Apr. 1999, pp. 433-442, vol. 47, Issue 4.

J.B. Thomas, Cross-Coupling in Coaxial Cavity Filters—A Tutorial Overview, IEEE Transactions on Microwave Theory and Techniques, Apr. 2003, pp. 1368-1376, vol. 51, Issue 4, Part 2.

J.D. Rhodes and R.J. Cameron, General Extracted Pole Synthesis Technique with Application to Low-Loss TE011 Mode Filters, IEEE Transactions on Microwave Theory and Techniques, Sep. 1980, pp. 1018-1028, vol. 28, Issue 9.

(Continued)

*Primary Examiner* — Seungsook Ham
(74) *Attorney, Agent, or Firm* — Bereskin & Parr LLP; Isis E. Caulder

(57) ABSTRACT

An inline microwave bandpass filter where cross coupling between non-adjacent resonators is realized by changing the orientation of selected resonators. The microwave bandpass filter includes a cavity and three or more resonators arranged in a row (or inline) in the cavity. At least one resonator has a different spatial orientation from at least one other resonator. For example, one or more of the resonators may be rotated 90 or 180 degrees with respect to one of the other resonators. This arrangement of resonators facilitates sequential coupling between pairs of adjacent resonators and cross coupling between at least one pair of non-adjacent resonators without the use of additional cross coupling structures such as dedicated coupling probes or extra cavities. One or more plates may be introduced between adjacent resonators to independently control the sequential and cross coupling.

16 Claims, 23 Drawing Sheets

OTHER PUBLICATIONS

S. Amari and G. Macchiarella, Synthesis of Inline Filters With Arbitrarily Placed Attenuation Poles by Using Nonresonating Nodes, IEEE Transactions on Microwave Theory and Techniques, Oct. 2005, pp. 3075-3081, vol. 53, Issue 10.

M.E. Sabbagh, K.A. Zaki, H. Yao, and M. Yu, Full-Wave Analysis of Coupling Between Combline Resonators and Its Application to Combline Filters With Canonical Configurations, IEEE Transactions on Microwave Theory and Techniques, Dec. 2001, pp. 2384-2393, vol. 49, Issue 12.

R.W. Rhea, HF Filter Design and Computer Simulation, 1995, pp. 321-326, McGraw-Hill, Inc.

R.J. Cameron, C.M. Kudsia and R.R. Mansour, Microwave Filters for Communication Systems: Fundamentals, Design and Applications, 2007, pp. 507-509, John Wiley & Sons, Inc.

H. Yao, K.A. Zaki, A.E. Atia, and R. Hershtig, Full Wave Modeling of Conducting Posts in Rectangular Waveguides and Its Applications to Slot Coupled Combline Filters, IEEE Transactions on Microwave Theory and Techniques, Dec. 1995, pp. 2824-2830, vol. 43, Issue 12.

C. Wang, H. Yao, K.A Zaki, and R.R. Mansour, Mixed Modes Cylindrical Planar Dielectric Resonator Filters with Rectangular Enclosure, IEEE Transactions on Microwave Theory and Techniques, Dec. 1995, pp. 2817-2823, vol. 43, Issue 12, Part 2.

M.A. Ismail, D. Smith, A. Panariello, Y. Wang and M. Yu, EM-Based Design of Large-Scale Dielectric-Resonator Filters and Multiplexers by Space Mapping, IEEE Transactions on Microwave Theory and Techniques, Jan. 2004, pp. 386-392, vol. 52, Issue 1, Part 2.

* cited by examiner

INLINE CROSS-COUPLED COAXIAL CAVITY FILTER

FIELD

The described embodiments relate to microwave bandpass filters. More particularly, the described embodiments relate to inline cross-coupled microwave bandpass filters.

BACKGROUND

In microwave bandpass filter design, transmission zeros (TZs) on one or both sides of the passband are frequently required in order to meet rejection requirements. Transmission zeros are often realized by couplings between non-adjacent resonators, often referred to as cross couplings.

Folded structures are often used to realize couplings between non-adjacent resonators. However, folded structures may not be suitable where there are structural constraints that require an inline configuration and/or input and output connectors on opposite sides of the two end resonators.

One technique used to realize transmission zeros for an inline configuration is to use a coupling probe embedded in the housing of the filter. Reference is now made to FIG. 1A in which an inline cross-coupled microwave bandpass filter 100 in accordance with the prior art is illustrated. The filter 100 includes a housing 102, six cavities 104*a* to 104*f*, six resonators 106*a* to 106*f* situated in the cavities 104*a* to 104*f*, an input port 108 extending into the first cavity 104*a*, and an output port 110 extending into to the sixth cavity 104*f*. The filter 100 also includes a coupling probe 112 extending into the first and third cavities 104*a* and 104*c* to realize coupling between the first and third resonators 106*a* and 106*c*. However, such a long coupling probe 112 generates unwanted resonances.

Reference is now made to FIG. 1B in which the frequency response of the bandpass filter 100 of FIG. 1A centered at 1.54 GHz is illustrated. It can be seen from FIG. 1B that in addition to generating a transmission zero 130 in the upper stop band, the coupling probe 112 resonates and generates a spike 132 in the lower stop band. Other disadvantages for such filters include the difficulty of tuning the cross-coupling.

Other techniques used to realize transmission zeros for an inline configuration include: (1) the extracted pole technique described in J. R. Rhodes and R. J. Cameron, "General extracted pole synthesis technique with application to low-loss TE011-mode filters," *IEEE Trans. Microwave Theory and Tech.*, vol. 28, pp. 1018-1028, September 1980; and (2) the application of non-resonating nodes described in S. Mari and G. Macchiarella, "Synthesis of inline filters with arbitrarily placed attenuation poles by using non-resonating nodes," *IEEE Trans. Microwave Theory and Tech.*, vol. 53, pp. 3075-3081, October 2005. However, both techniques require additional resonating or non-resonating structures.

SUMMARY

Embodiments described herein relate to inline microwave bandpass filters where cross couplings between non-adjacent resonators is realized by changing the orientation of selected resonators.

In one broad aspect there is provided a microwave bandpass filter comprising: (a) a cavity defined by a tubular structure and two opposing end walls, the tubular structure having a first end and a second end, one of the opposing end walls being attached to the first end and the other of the opposing end walls being attached to the second end; (b) at least three resonators arranged in a row in the cavity, connected by apertures, wherein at least one resonator has a different spatial orientation from at least one other resonator; (c) an input connector coupled to a first resonator of the at least three resonators; and (d) an output connector coupled to a second resonator of the at least three resonators.

Such a microwave bandpass filter facilitates sequential coupling between pairs of adjacent resonators and cross coupling between at least one pair of non-adjacent resonators without the use of additional cross coupling structures such as dedicated coupling probes or extra cavities.

BRIEF DESCRIPTION OF THE DRAWINGS

For a better understanding of embodiments of the systems and methods described herein, and to show more clearly how they may be carried into effect, reference will be made, by way of example, to the accompanying drawings in which.

Figure 1A:
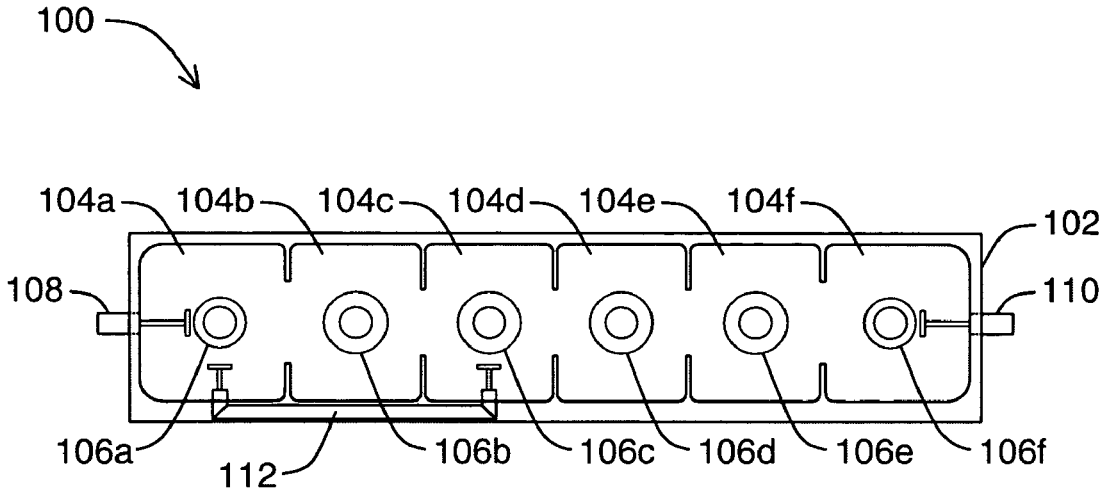
FIG. 1A PRIOR ART
FIG. 1A is a top-view of a bandpass filter of the prior art.
Figure 1B:
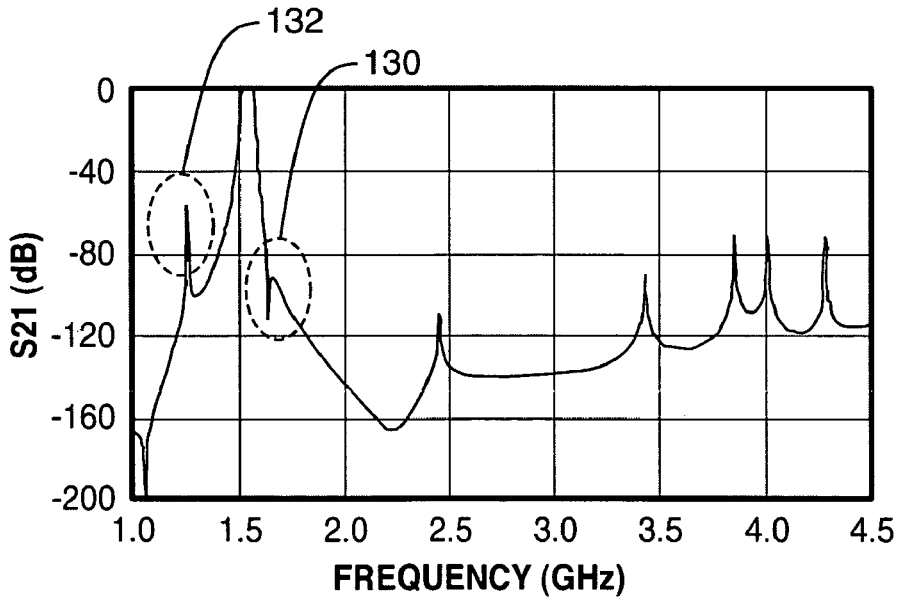
FIG. 1B PRIOR ART
FIG. 1B is a graph of the frequency response of the bandpass filter of FIG. 1A.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Embodiments described herein relate to inline bandpass filters where cross couplings between non-adjacent resonators is realized by changing the orientation of selected resonators. For example, one or more of the resonators may be rotated 90 degrees or 180 degrees with respect to one or more of the resonators. In some embodiments, plates are introduced between adjacent resonators to control the sequential couplings between the adjacent resonators.

Figure 2A:
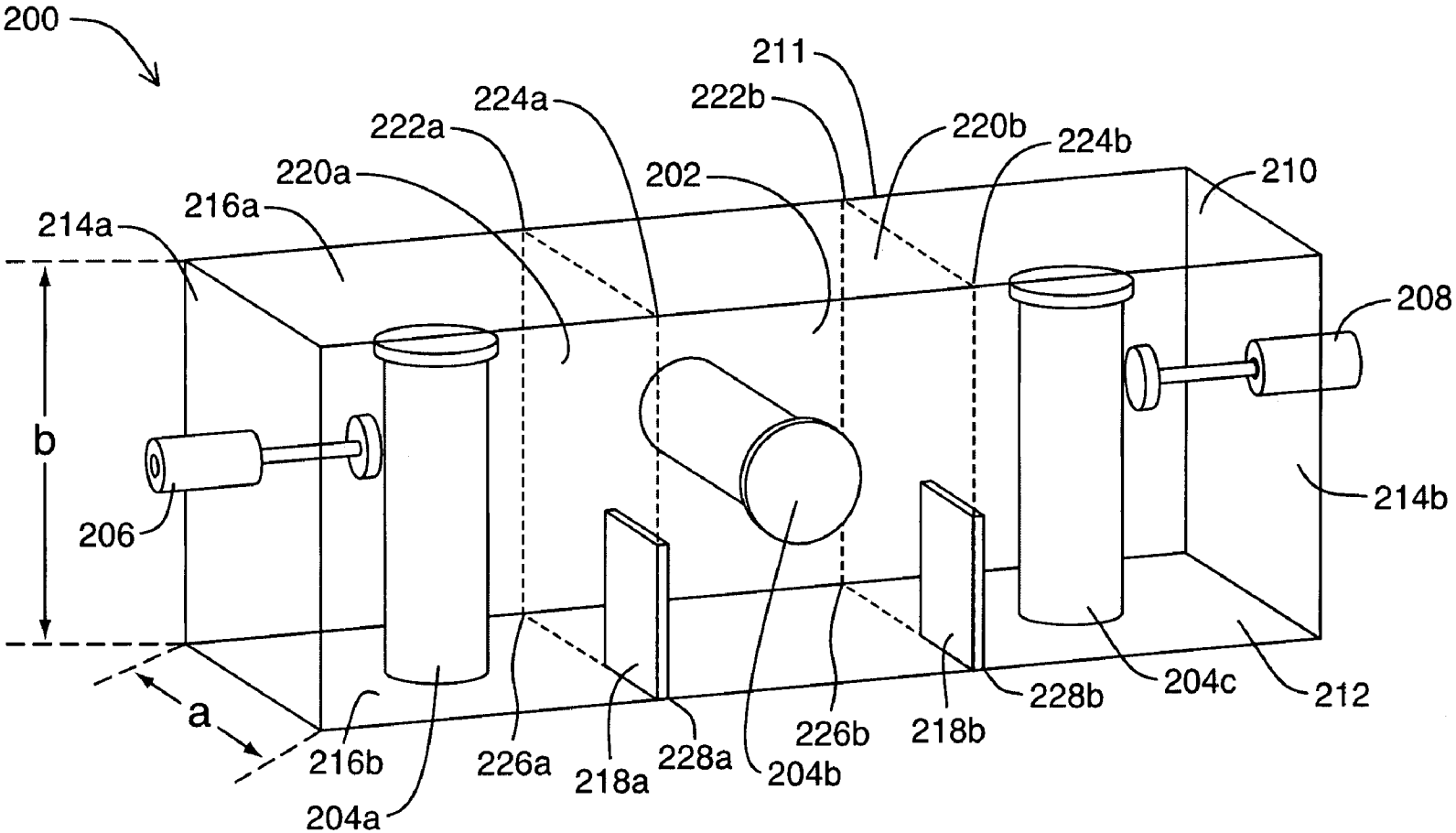
FIG. 2A is a perspective view of a bandpass filter in accordance with at least one embodiment.
Figure 2B:
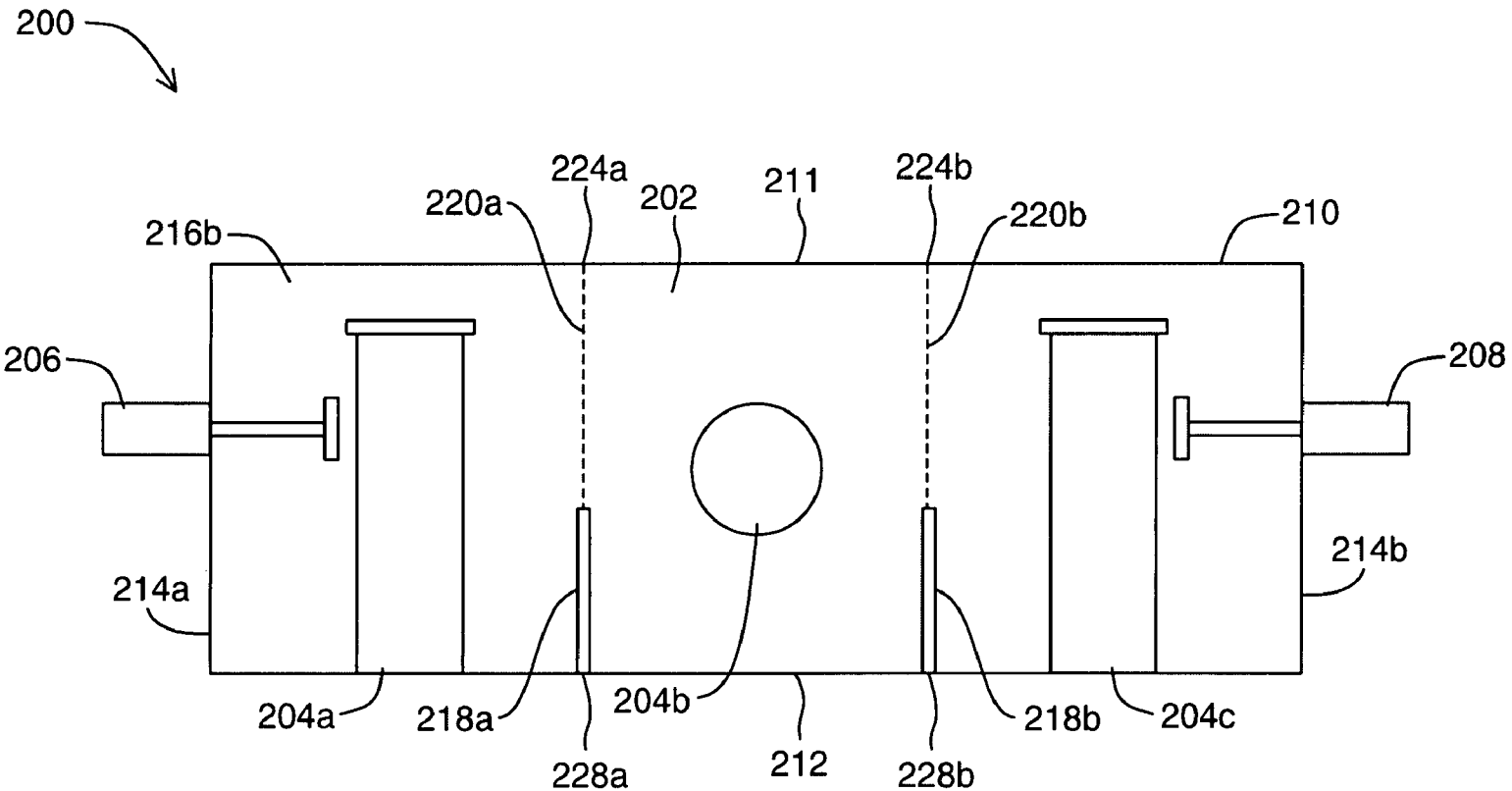
FIG. 2B is a side view of the bandpass filter of FIG. 2A.
Figure 2C:
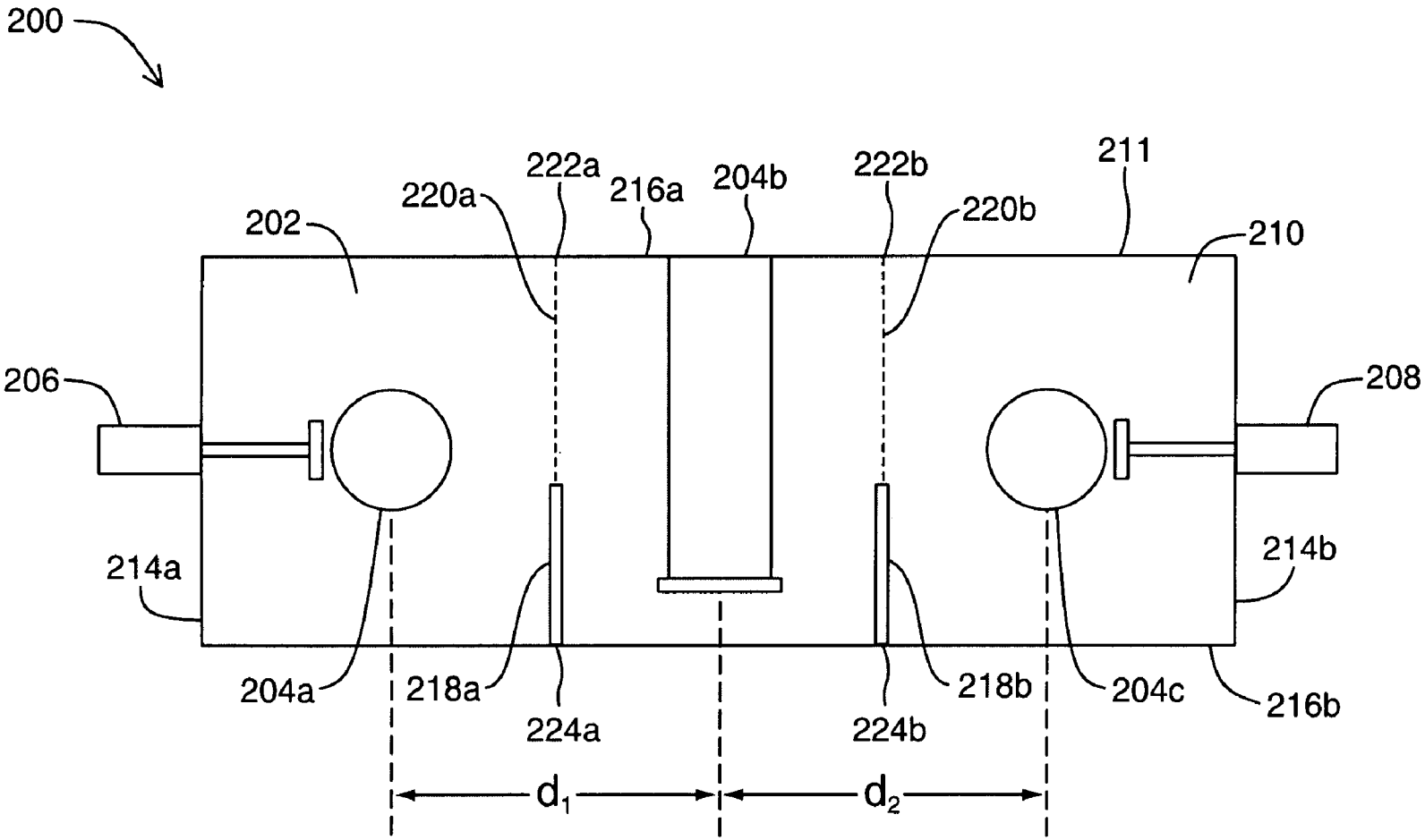
FIG. 2C is a top view of the bandpass filter of FIG. 2A.

Reference is now made to FIGS. 2A to 2C, in which a microwave bandpass filter 200 in accordance with an embodiment is illustrated. FIG. 2A is a perspective view of the bandpass filter 200, FIG. 2B is a side view of the bandpass filter 200, and FIG. 2C is a top view of the bandpass filter 200.

The bandpass filter 200 includes a cavity 202, three resonators 204*a*, 204*b*, and 204*c* arranged in a row in the cavity 202, an input connector 206 connected to the first resonator 204*a*, and an output connector 208 connected to the third resonator 204*c*. Although the input and output connectors 206 and 208 are shown in FIGS. 2A to 2C as being connected to the first and third resonators 204*a* and 204*c*, the input and output connectors 206 and 208 may be connected to any of the resonators.

The cavity 202 is defined by a tubular structure 211 and two opposing end walls 214*a* and 214*b* attached to either end of the tubular structure 211. In some embodiments, as shown in FIGS. 2A to 2C, the tubular structure 211 has a rectangular shape, and is defined by a top wall or lid 210 (which may be removable), a bottom wall 212, and two opposing side walls 216*a* and 216*b* that extend between the top wall 210 and the bottom wall 212. In these embodiments, the cavity 202 has a width a and a height b (FIG. 2A). In other embodiments, the tubular structure has a cylindrical shape and is defined by a single continuous wall (not shown).

The cavity walls 210, 212, 214*a*, 214*b*, 216*a* and 216*b* are typically made of a suitable metal such as aluminum or copper. However, the cavity walls 210, 212, 214*a*, 214*b*, 216*a* and 216*b* may be made of other suitable metals. Although the cavity walls 210, 212, 214*a*, 214*b*, 216*a* and 216*b* are typically translucent, for ease of explanation, the cavity walls 210, 212, 214*a*, 214*b*, 216*a* and 216*b* are shown in FIGS. 2A to 2C as being transparent.

The three resonators 204*a*, 204*b* and 204*c* are arranged in a row or "inline" in the cavity. In inline filters, the centers of the resonators are aligned along the same longitudinal axis as opposed to, for example, filters with resonators arranged in two or more rows. Although the filter 200 is shown as having three resonators 204*a*, 204*b*, and 204*c*, filters in accordance with embodiments described herein may have three or more resonators. The number of resonators is typically selected based on the filter requirements. Preferably, the resonators 204*a*, 204*b* and 204*c* are coaxial resonators with square or rectangular cavity cross-sections. However, the resonators 204*a*, 204*b*, and 204*c* may be any type of suitable coaxial resonator.

The first and second resonators 204*a* and 204*b* are separated by a distance $d_1$, and the second and third resonators 204*b* and 204*c* are separated by a distance $d_2$ (FIG. 2C). The distance $d_1$ between the first and second resonators 204*a* and 204*b* may by the same as, or different than, the distance $d_2$ between the second and third resonators 204*b* and 204*c*. The distances $d_1$ $d_2$ between resonators are typically measured from the centre points of the resonators 204*a*, 204*b* and 204*c*.

At least one of the resonators 204*a*, 204*b*, and 204*c* has a different spatial orientation from at least one other resonator. For example, one or more of the resonators 204*a*, 204*b*, or 204*c* may be rotated between 1 degree and 360 degrees with respect to one of the other resonators 204*a*, 204*b*, or 204*c*. In a preferred embodiment, one or more resonators 204*a*, 204*b* and 204*c* is rotated 90 degrees or 180 degrees from one of the other resonators.

In some embodiments, such as the embodiment shown in FIGS. 2A to 2C, the second resonator 204*b* is rotated with respect to the first and third resonators 204*a* and 204*c* so that the second resonator 204*b* has a different orientation from the first and third resonators 204*a* and 204*c*. For example, as shown in FIGS. 2A to 2C, the second resonator 204*b* may be rotated 90 degrees with respect to the first and third resonators 204*a* and 204*c* so that the first and third resonators 204*a* and 204*c* are substantially vertical and the second resonator 204*b* is substantially horizontal.

Figure 13A:
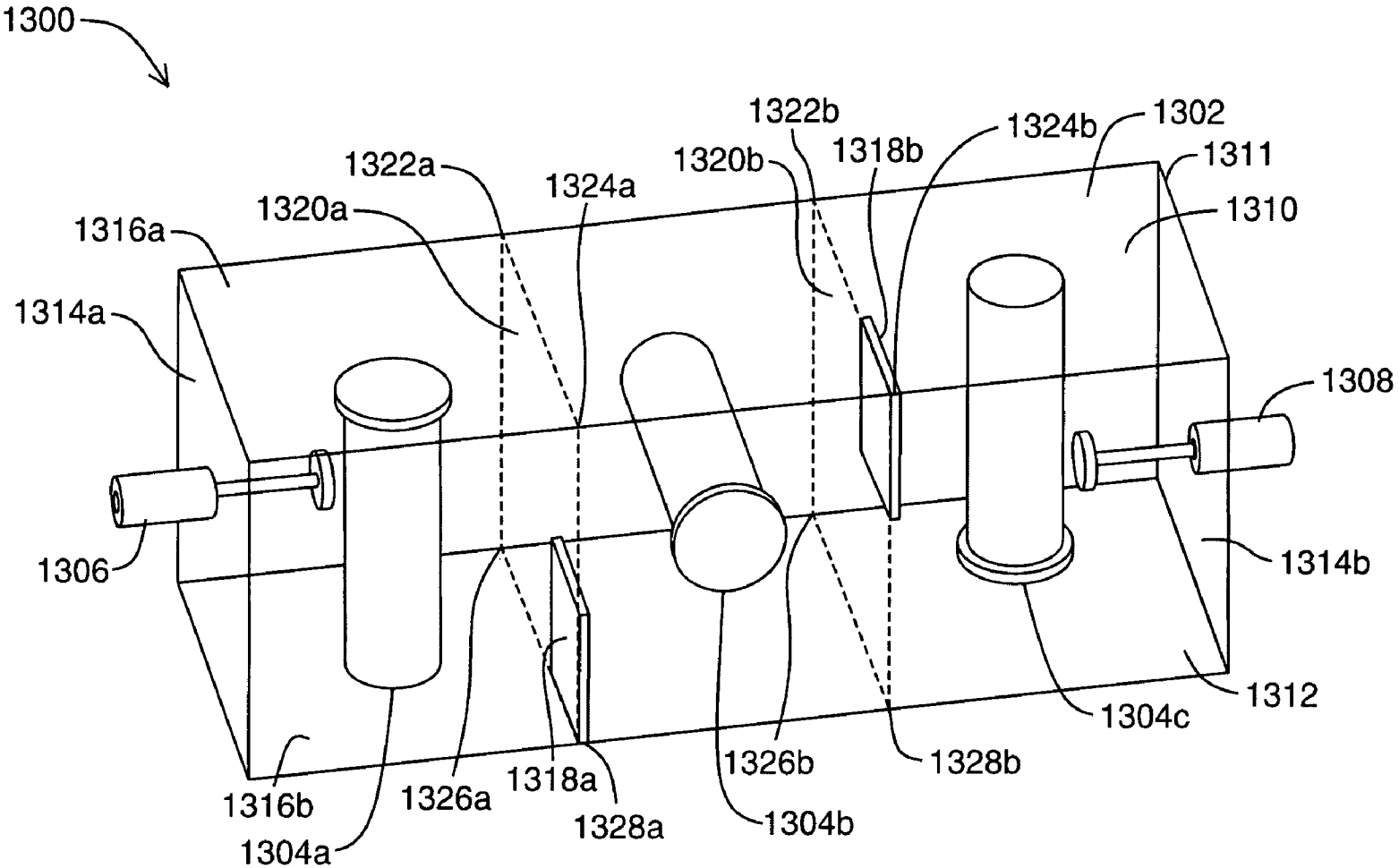
FIG. 13A is a perspective view of a bandpass filter in accordance with at least one embodiment.
Figure 13B:
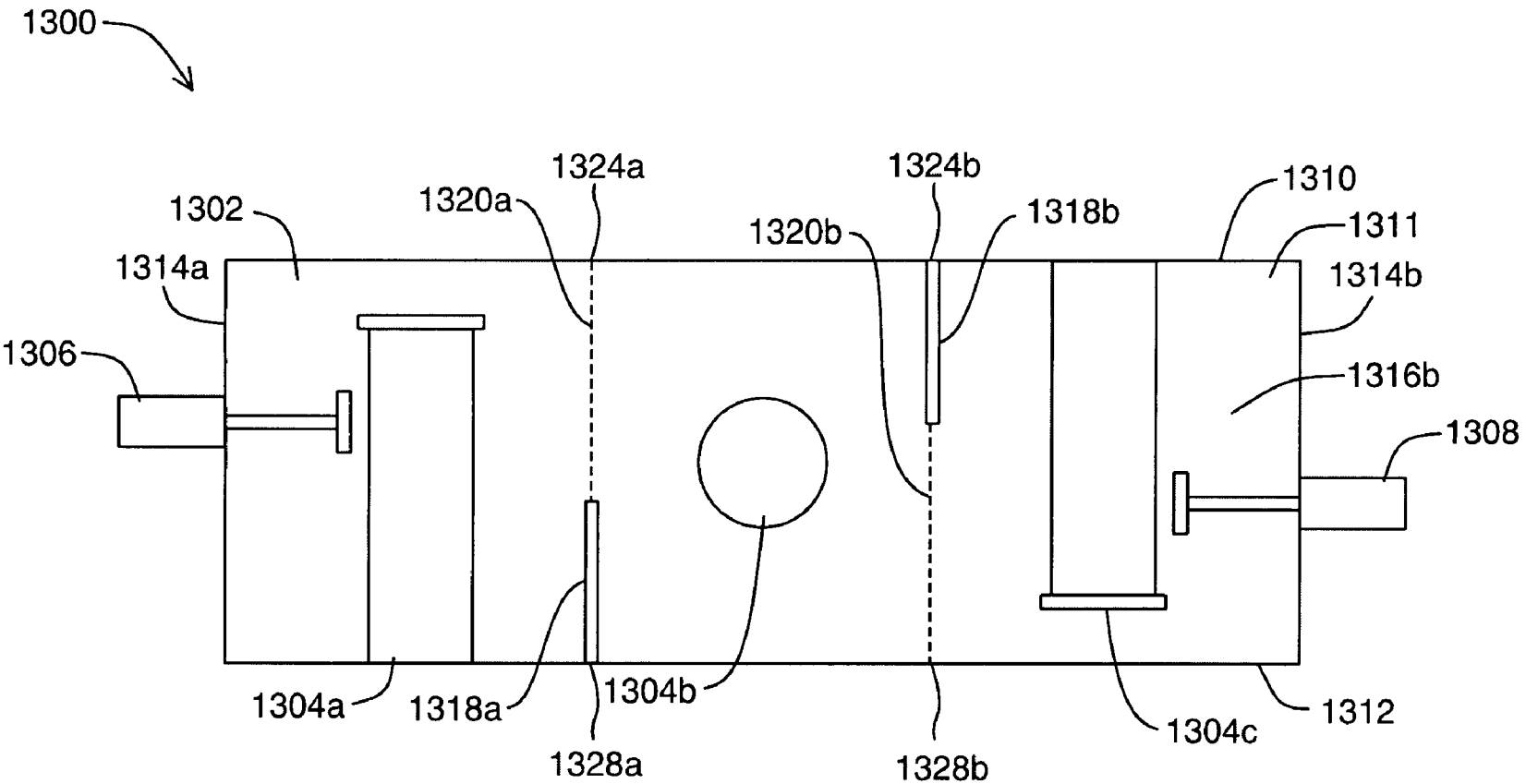
FIG. 13B is a side view of the bandpass filter of FIG. 13A.
Figure 13C:
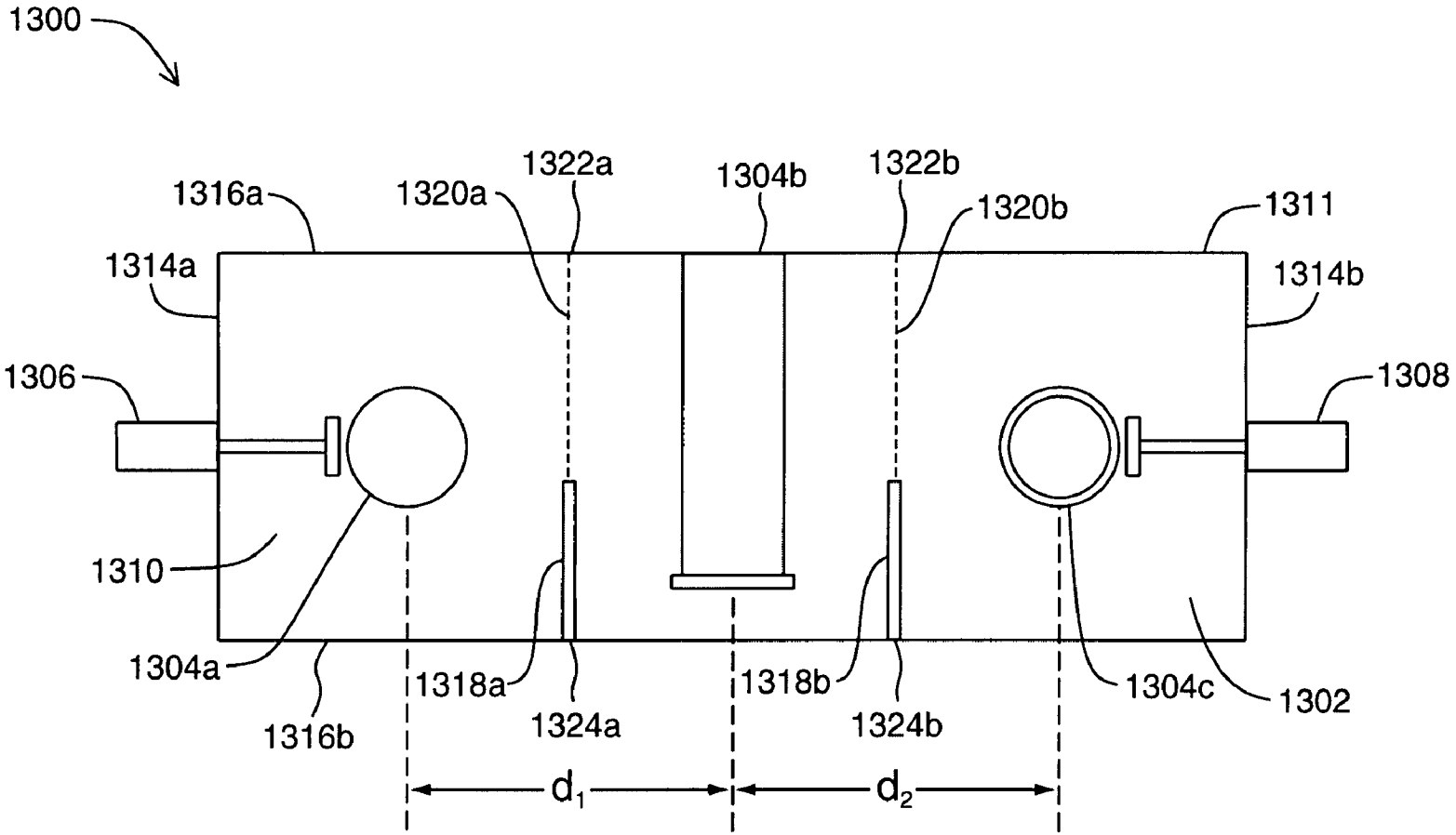
FIG. 13C is a top view of the bandpass filter of FIG. 13A.

In other embodiments, such as the embodiment shown in FIGS. 13A to 13C, the third resonator is also rotated with respect to the first resonator so that both the second and third resonators have different orientations from the first resonator. For example, as shown in FIGS. 13A to 13C, the third resonator may be rotated 180 degrees with respect to the first resonator so that it can be said to be is upside down with respect to the first resonator.

By having at least one resonator 204*a*, 204*b*, and 204*c* with a different orientation, the filter 200 of FIGS. 2A to 2C not only realizes sequential coupling between adjacent resonators (e.g. between first and second resonators 204*a* and 204*b*, and second and third resonators 204*b* and 204*c*), but it also realizes cross coupling between at least one pair of non-adjacent resonators (e.g. between first and third resonators 204*a* and 204*c*). Unlike the prior art filters, the cross coupling is achieved without the use of additional cross coupling structures such as dedicated coupling probes or extra cavities.

Each cross coupling (coupling between non-adjacent resonators) creates a transmission zero in the upper or lower stop band, or both. Where the second resonator 204*b* is rotated 90 degrees with respect to the first and third resonators 204*a* and 204*c*, as shown in FIGS. 2A to 2C, the cross coupling between the first and third resonators 204*a* and 204*c* produces a transmission zero in the upper stop band. Where, however, the second resonator 204*b* is rotated 90 degrees with respect to the first resonator 204*a*, and the third resonator 204*c* is rotated 180 degrees with respect to the first resonator 204*a*, as shown in FIGS. 13A to 13C, the cross coupling between the first and third resonators 204*a* and 204*c* produces a transmission zero in the lower stop band.

Additional resonators may be added to the filter 200 to increase the number of cross couplings or the number of transmission zeros, or both. For example, a filter having four resonators where the second and third resonators are rotated 90 degrees with respect to the first resonator (i.e. the first resonator is substantially vertical and the second and third resonators are substantially horizontal), and the fourth resonator is rotated 180 degrees with respect to the first resonator (i.e. the fourth resonator is upside down), will realize cross coupling between the first and fourth resonators that produces a pair of transmission zeros, one in the lower stop band and one in the upper stop band.

In addition, because the sequential coupling between adjacent resonators (e.g. first and second resonators 204*a* and 204*b*) in this configuration is dominantly magnetic coupling, rotation of the second resonator 204*b* by 90 degrees makes the inter-resonator coupling less effective compared to known combline configurations, which allows for a more compact design. Specifically, the resonators 204*a*, 204*b*, and 204*c* can be placed closer together.

The bandpass filter 200 may also include one or more plates 218*a* and 218*b* situated between adjacent resonators (e.g. first and second resonators 204*a* and 204*b*, or second and third resonators 204*b* and 204*c*) to allow independent control of the sequential and cross coupling. Specifically, by proper arrangement of the location and size of the plates 218*a* and 218*b* and the distance between resonators, the desired sequential and cross coupling coefficients can be realized. Although bandpass filter 200 is shown with only a single plate 218*a* and 218*b* between any pair of adjacent resonators, in other embodiments, there may be more than one plate between a pair of adjacent resonators.

In one embodiment, the plates 218*a* and 218*b* are rectangular metal walls with a height H and length L. In some cases, the height H and the length L of the plates 218*a* and 218*b* are the same so that the plates are square. However, the plates 218*a* and 218*b* may have other suitable shapes and sizes. Preferably the plates 218*a* and 218*b* are made of the same materials as the cavity walls 210, 212, 214*a*, 214*b*, 216*a* and 216*b* (i.e. aluminum or copper). However, the plates 218*a* and 218*b* may be made of other suitable materials. In some embodiments, the plates 218*a* and 218*b* are machined as part of the cavity walls 212, 214*a*, 214*b*, 216*a*, 216*b* and 210.

Each plate 218*a* and 218*b* is typically situated within a plane 220*a* or 220*b* that is substantially parallel to the end walls 214*a* and 214*b* so that each plate 218*a* and 218*b* is substantially parallel to the end walls 214*a* and 214*b*. Each plane 220*a* and 220*b* is defined by an upper left-corner 222*a*, 222*b*, an upper right-corner 224*a*, 224*b*, a lower left corner 226*a*, 226*b* and a lower right corner 228*a*, 228*b*. The upper left-corner 222*a*, 222*b* is the corner of the plane 220*a*, 220*b* formed by the first side wall 216*a* and the lid 210, the upper right-corner 224*a*, 224*b* is the corner of the plane 220*a*, 220*b* formed by the second side wall 216*b* and the lid 210, the lower left corner 226*a*, 226*b* is the corner of the plane 220*a*, 220*b* formed by the first side wall 216*a* and the bottom wall 212, and the lower right corner 228*a*, 228*b* is the corner of the plane 220*a*, 220*b* formed by the second side wall 216*b* and the bottom wall 212. Each plate 218*a* and 218*b* is typically situated in one corner 222*a*, 224*a*, 226*a* and 228*a* or 222*b*, 224*b*, 226*b*, and 228*b* of a plane 220*a* or 220*b*.

Figure 3A:
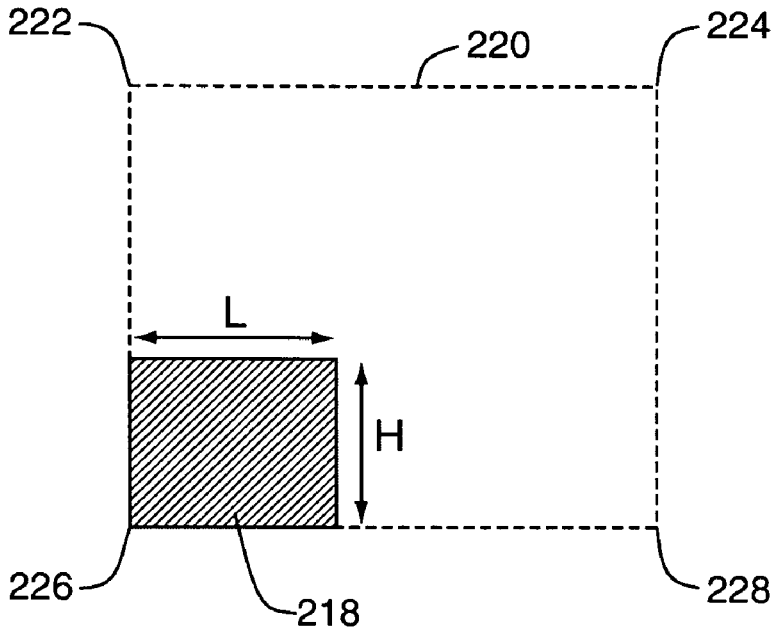
FIG. 3A is a side view of a plate in the lower-left corner.
Figure 3B:
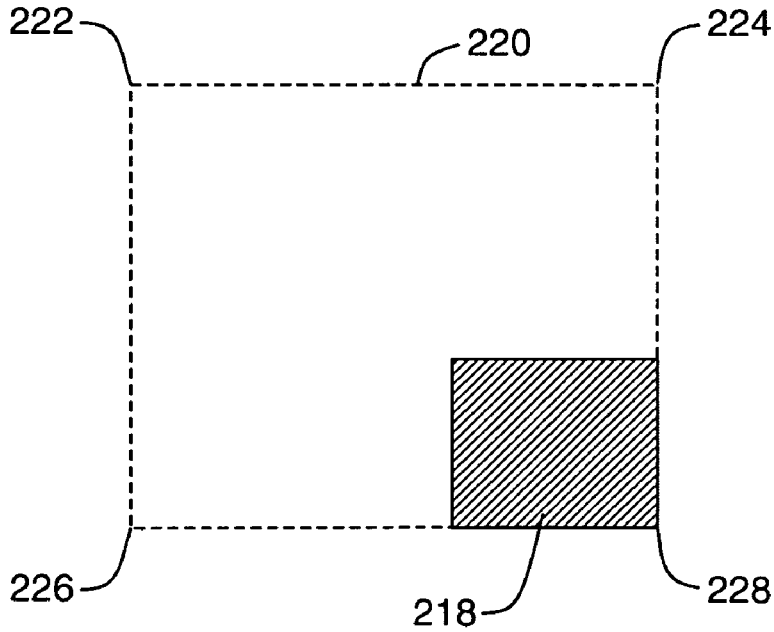
FIG. 3B is a side view of a plate in the lower-right corner.

Reference is now made to FIGS. 3A and 3B, which illustrate a plate 218 in the lower-left corner 226 and the lower right corner 228 of a plane 220 respectively.

Increasing the size of the plate when it is positioned in some of the corners will increase the sequential coupling coefficient, and increasing the plate size when it is positioned in other corners will decrease the sequential coupling coefficient. The corners which result in an increase in the sequential coupling coefficient will be referred to as increase positions, and the corners which result in a decrease in the sequential coupling coefficient will be referred to as decrease positions. The determination of which corners act as increase positions and which corners act as decrease positions depends on (1) the orientation of the resonators on either side of the plate, and (2) the size of the plate. This means that a corner may change from being a decrease position to an increase position as the size of the plate changes. For example, some corners may be decrease positions when the plate size is less than a threshold value, and increase positions when the plate size is greater than the threshold value.

Each plane 220*a* and 220*b* (and incidentally each plate 218*a* and 218*b*) is typically situated at the mid-point between adjacent resonators (e.g. at the mid-point between the first and second resonators 204*a* and 204*b*, or at the mid-point between the second and third resonators 204*b* and 204*c*). However, the planes 220*a* and 220*b* may be situated at any point between adjacent resonators.

The filter 200 may also include sequential coupling and/or cross coupling tuning elements (not shown). For example, filter 200 may include tuning screws situated on one or more cavity walls 210, 212, 214*a*, 214*b*, 216*a* and 216*b*. The position of the tuning screws on the cavity walls is typically based on the orientation of the resonators within the cavity 202. For example, in the filter 200 shown in FIGS. 2A to 2C, tuning screws may be placed on the lid 210 or the bottom wall 212 between cross coupled resonators (e.g. between first and third resonators 204*a* and 204*c*) to facilitate tuning of the cross coupling. Filter 200 may also include tuning screws placed on one of the side walls 216*a* or 216*b* between adjacent resonators (e.g. between first and second resonators 204*a* and 204*b* and between second and third resonators 204*b* and 204*c*) for adjusting the sequential coupling. Accordingly, all sequential and cross couplings can be effectively adjusted.

To illustrate how the sequential coupling coefficient is affected by (i) the location of a plate; (ii) the size of a plate; and (iii) the distance between resonators, reference is made to FIG. 4, which illustrates a two-coupled resonator structure 400 for eigenmode calculation. The two-coupled resonator structure 400 has the same configuration as the bandpass filter 200 of FIGS. 2A to 2C except it comprises only two resonators 404*a* and 404*b* and it does not include input and output connectors. Elements of the two-coupled resonator structure 400 that correspond to microwave bandpass filter 200 will be identified by similar reference numerals. Generally, corresponding elements will share the same last two digits. For example, the cavity 202 of the filter 200 of FIGS. 2A to 2C corresponds to the cavity 402 of the resonator structure 400 of FIG. 4.

Similar to bandpass filter 200, the first resonator 404*a* of resonator structure 400 has a substantially vertical orientation, and the second resonator 404*b* of resonator structure 400 has a substantially horizontal orientation. Accordingly, it can be said that the second resonator 404*b* is rotated 90 degrees with respect to the first resonator 404*a*.

Figure 4:
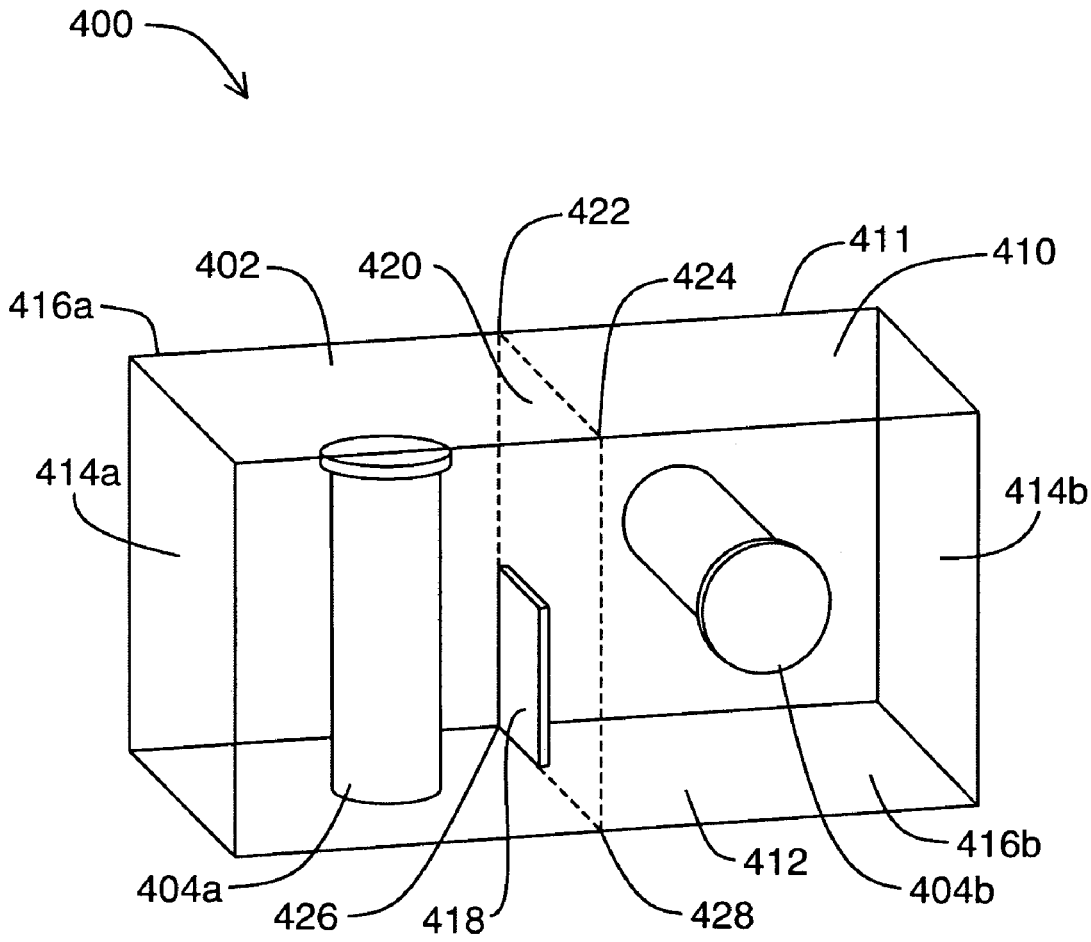
FIG. 4 is a perspective view of a two-coupled resonator structure.

When two resonators have the same resonant frequency, equation (1) can be used to calculate the coupling coefficient k where $f_1$ and $f_2$ are the two eigenmodes of the resonator structure 400 of FIG. 4. The two eigenmodes ($f_1$ and $f_2$) can be calculated using the eigenmode solver of an electromagnetic (EM) field simulator, such as Ansoft Corporation's HFSS™.

$$|k| = \left|\frac{f_1^2 - f_2^2}{f_1^2 + f_2^2}\right| \quad (1)$$

Figure 5A:
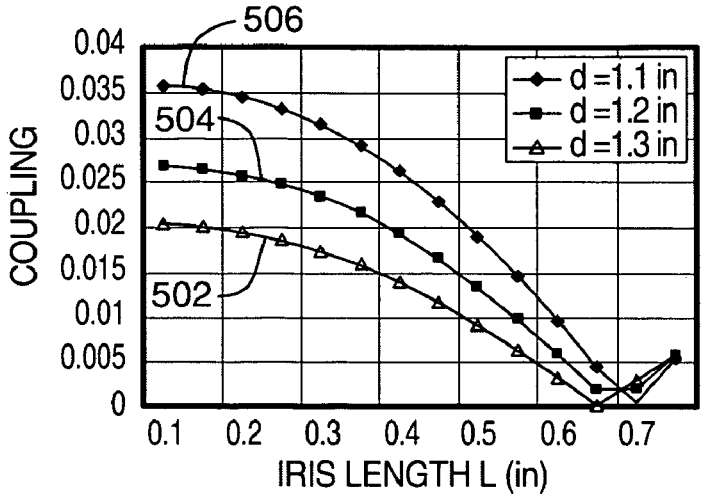
FIG. 5A is a graph of the sequential coupling coefficient for the resonator structure of FIG. 4 when the plate is in the lower-left corner.
Figure 5B:
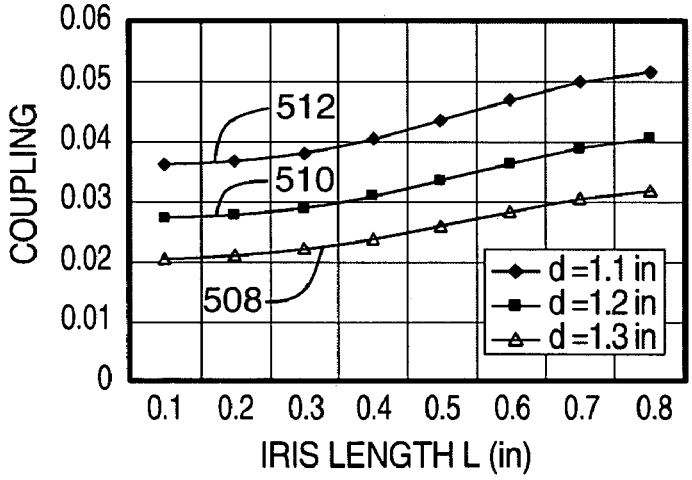
FIG. 5B is a graph of the sequential coupling coefficient for the resonator structure of FIG. 4 when the plate is in the lower-right corner.
Figure 5C:
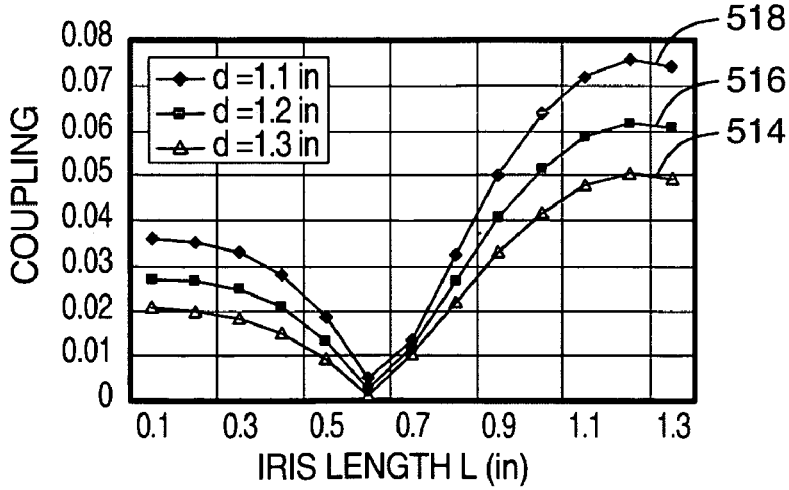
FIG. 5C is a graph of the sequential coupling coefficient for the resonator structure of FIG. 4 when the plate is in the upper-right corner.

Reference is now made to FIGS. 5A to 5C, which illustrate the sequential coupling coefficient for the resonator structure 400 of FIG. 4 as a function of the length (or height) of the square plate 418 when the cavity 402 width and height are both 1.5 inches, both resonators 404*a* and 404*b* have a diameter of 0.4 inches and a height of 1.3 inches, the distance between the first resonator 404*a* and the first end wall 414*a* is 0.75 inches and the distance between the second resonator 404*b* and the second end wall 414*b* is 0.75 inches. Each of FIGS. 5A to 5C illustrates the sequential coupling coefficient for the resonant structure 400 of FIG. 4 when the plate 418 is in a different corner 422, 424, 426 or 428 of the plane 420. Specifically, FIG. 5A illustrates the sequential coupling coefficient for the resonator structure 400 of FIG. 4 when the plate 418 is positioned in the bottom-left corner 426 of the plane 420, FIG. 5B illustrates the sequential coupling coefficient for the resonant structure 400 of FIG. 4 when the plate 418 is positioned in the bottom-right corner 428 of the plane 420, and FIG. 5C illustrates the sequential coupling coefficient for the resonator structure 400 of FIG. 4 when the plate 418 is positioned in the upper-right corner 424 of the plane 420.

FIG. 5A includes three coupling coefficient curves 502, 504, and 506 illustrating the sequential coupling coefficient when the plate 418 is positioned in the bottom left corner 426 of the plane 420 and the resonators 404*a* and 404*b* are separated by distances of 1.3 inches, 1.2 inches, and 1.1 inches respectively. It is clear from the three coupling coefficient curves 502, 504 and 506 that, regardless of the distance between the resonators 404*a* and 404*b*, when the plate 418 is positioned in the bottom left corner 426 of the plane 420 the sequential coupling coefficient decreases as the length (or height) of the square plate 418 increases. Accordingly, when the resonators are oriented in the manner shown in FIG. 4—specifically the first resonator 404*a* is substantially vertical and the second resonator 404*b* is substantially horizontal—the bottom-left corner 426 is a decrease position as that term was defined above. In this position, the plate 418 reduces the magnetic coupling between the resonators 404*a* and 404*b* and thus reduces the total coupling. It can be seen from FIG. 5A, that the sequential coupling coefficient reduces to zero when the length of the plate 418 is about half of the resonator height (e.g. ~0.65 inches when the resonator height is 1.3 inches). After this point, the coupling changes from magnetic coupling to electric coupling and the total coupling begins to increase.

FIG. 5B includes three coupling coefficient curves 508, 510, and 512 illustrating the sequential coupling coefficient when the plate 418 is positioned in the bottom right corner 428 of the plane 420 and the resonators 404*a* and 404*b* are separated by distances of 1.3 inches, 1.2 inches, and 1.1 inches respectively. It is clear from the three coupling coefficient curves 508, 510 and 512 of FIG. 5B that, regardless of the distance between the resonators 404*a* and 404*b*, when the plate 418 is positioned in the bottom right corner 428 of the plane 420, the sequential coupling coefficient increases as the length of the plate 418 increases. Accordingly, when the resonators are oriented in the manner shown in FIG. 4—specifically, the first resonator 404*a* is substantially vertical and the second resonator 404*b* is substantially horizontal—the bottom right corner 428 is an increase position as that term was defined above. In this configuration, the plate 418 reduces the electric coupling between the resonators 404*a* and 404*b* and thus increases the total coupling. A plate 418 positioned in the upper-left corner 422 has the same effect on the sequential coupling coefficient as a plate positioned in the bottom right corner 428.

FIG. 5C includes three coupling coefficient curves 514, 516, and 518 illustrating the sequential coupling coefficient when the plate 418 is positioned in the upper-right corner 424 of the plane 420 and the resonators 404*a* and 404*b* are separated by distances of 1.3 inches, 1.2 inches, and 1.1 inches respectively. It is clear from the three coupling coefficient curves 514, 516, and 518 that, regardless of the distance between the resonators 404*a* and 404*b*, when the plate 418 is positioned in the upper-right corner 424 of the plane 420, the sequential coupling coefficient decreases as the length of the plate 418 increases until the length of the plate 418 is roughly equal to half of the resonator height (e.g. ~0.65 inches when the resonator height is 1.3 inches), then the sequential coupling coefficient increases as the length of the plate increases. This is because when the plate 418 is positioned in the upper-right corner 424 increasing the length of the plate 418 increases the electric coupling. When the length of the plate 418 is less than half of the resonator height (e.g. ~0.65 inches when the resonator height is 1.3 inches), the coupling is magnetic coupling therefore as the electric coupling increases, the total coupling decreases. When the plate is greater than half of the resonator height (e.g. ~0.65 inches when the resonator height is 1.3 inches), however, the coupling changes to electric coupling and thus increasing the electric coupling, increases the total coupling.

Accordingly, when the resonators are oriented in the manner shown in FIG. 4—specifically, the first resonator 404*a* is substantially vertical and the second resonator 404*b* is substantially horizontal—the upper-right corner 424 is a decrease position when the length (or height) of the square plate 418 is less than half of the resonator height, and an increase position when the length (or height) or the square plate 418 is greater than half of the resonator height.

FIGS. 5A to 5C also illustrate that, regardless of the position and the size of the plate, the sequential coupling coefficient decreases as the distance d between resonators 404*a* and 404*b* increases.

Changing the thickness of the plate 418 has a similar effect on the sequential coupling as changing the length (or height) of the plate 418. For example, when the plate 418 is positioned in the bottom left corner 426 of the plane 420, the sequential coupling coefficient decreases as the thickness of the plate 418 increases. In some embodiments, the plate 418 has a thickness of 0.04 inches. However, the plate 418 may have any suitable thickness.

Accordingly, the sequential coupling between adjacent resonators (e.g. first and second resonators 404*a* and 404*b*) can be effectively controlled by changing (i) the size of the plate 418; (ii) the position of the plate 418; and (iii) the distance d between the resonators 404*a* and 404*b*. For example, by moving the same size plate 418 from the lower-left corner 426 to the lower-right corner 428, the sequential coupling can be significantly increased. Similarly, the same sequential coupling can be realized with different combinations of resonator distance, plate size, and plate location. Each of the combinations will result in different cross couplings.

Figure 6:
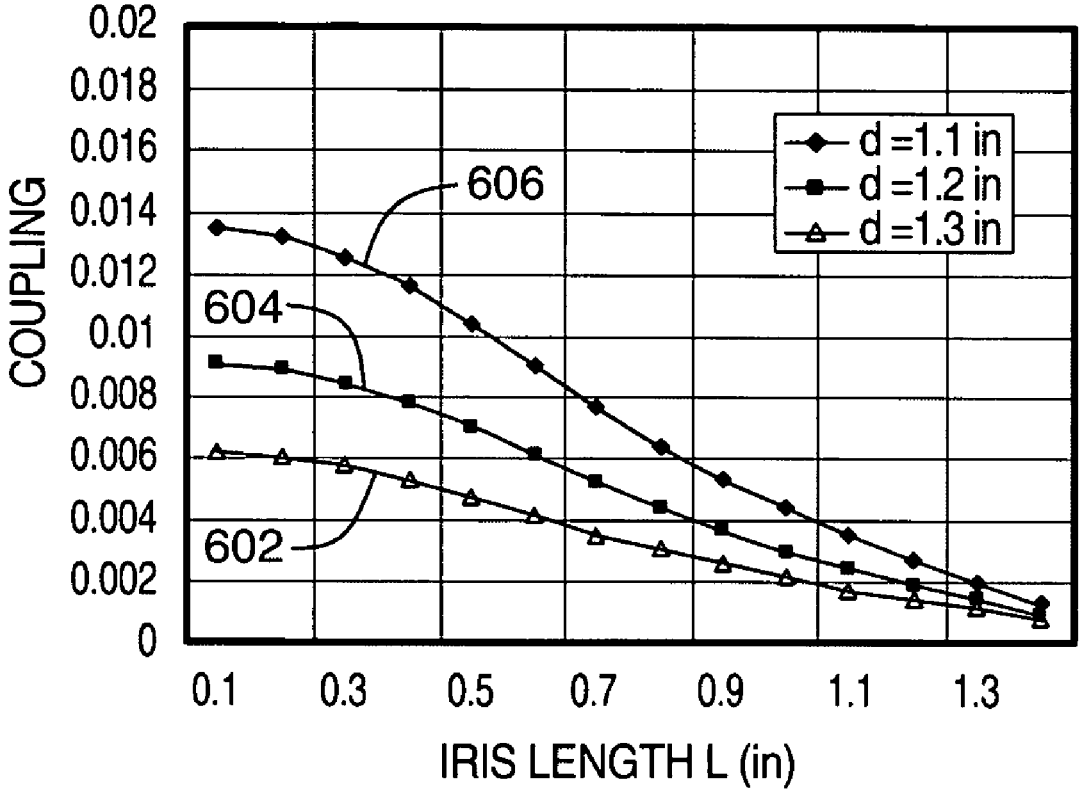
FIG. 6 is a graph of the cross coupling coefficient for the filter of FIG. 2A when the plate is in the lower-left corner.

To illustrate how the cross coupling coefficient is affected by the size of a plate and the distance between resonators, reference is made to FIG. 6, which illustrates the cross coupling coefficient for filter 200 of FIGS. 2A to 2C as a function of the length of the plates 218*a* and 218*b* when the plates 218*a* and 218*b* are positioned in the lower-left corner 226*a* and 226*b* of the respective planes 220*a* and 220*b*. FIG. 6 includes three cross coupling coefficient curves 602, 604 and 606 illustrating the cross coupling coefficient when adjacent resonators (i.e. the first and second resonators 204*a* and 204*b*, and second and third resonators 204*b* and 204*c*) are separated by a distance of 1.3 inches, 1.2 inches and 1.1 inches respectively. It can be seen from the three curves 602, 604, and 606 of FIG. 6 that the cross coupling coefficient reduces monotonically as the size of the plate increases and as the resonator distance increases. If the plates 218*a* and 218*b* are moved to the lower-right corner 228*a* and 228*b* of the respective planes 220*a* and 220*b*, the cross coupling coefficient curves are similar to the three curves 602, 604 and 606 of FIG. 6.

Figure 7:
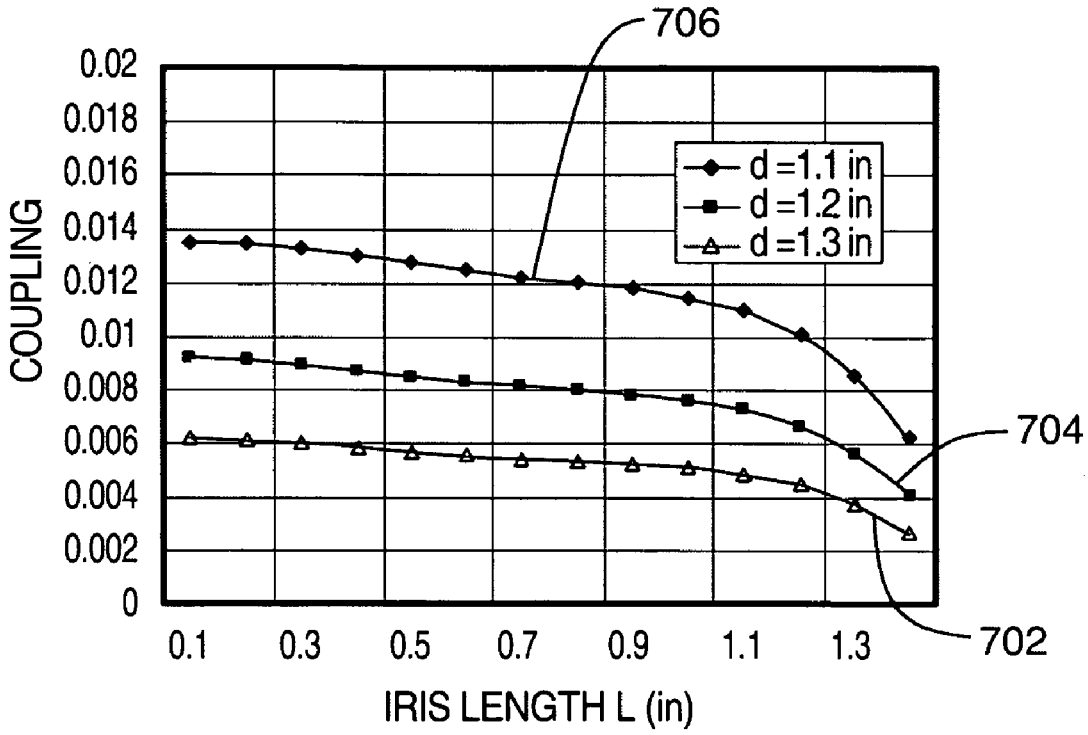
FIG. 7 is a graph of the cross coupling coefficient for the filter of FIG. 2A when the plate is in the upper-left corner.

Reference is now made to FIG. 7, which illustrates the cross coupling coefficient for filter 200 of FIGS. 2A to 2C as a function of the length of the plates 218*a* and 218*b* when the plates 218*a* and 218*b* are positioned in the top-left corner 222*a* and 222*b* of the respective planes 220*a* and 220*b*. FIG. 7 includes three cross coupling coefficient curves 702, 704 and 706 illustrating the cross coupling coefficient when adjacent resonators (i.e. the first and second resonators 204*a* and 204*b*, and second and third resonators 204*b* and 204*c*) are separated by a distance of 1.3 inches, 1.2 inches and 1.1 inches respectively. It can be seen from the three curves 702, 704, and 706 of FIG. 7 that, similar to the three curves 602, 604 and 606 of FIG. 6, the cross coupling coefficient reduces monotonically as the size of the plate increases and as the resonator distance increases. If the plates 218*a* and 218*b* are moved to the top-right corner 224*a* and 224*b* of the respective planes 220*a* and 220*b*, the cross coupling coefficient curves are similar to the three curves 702, 704 and 706 of FIG. 7.

The nonadjacent or cross coupling between non adjacent resonators may be calculated by detuning the second resonator 204*b* of FIGS. 2A to 2C, removing the input/output ports, finding the two resonant frequencies using the eigenmode solver of an EM field simulator, such as Ansoft Corporation's HFSS™, and then using equation (1) to calculate the cross coupling coefficient.

Changing the thickness of the plates 218*a* and 218*b* does not have significant impact on cross coupling.

Figure 8A:
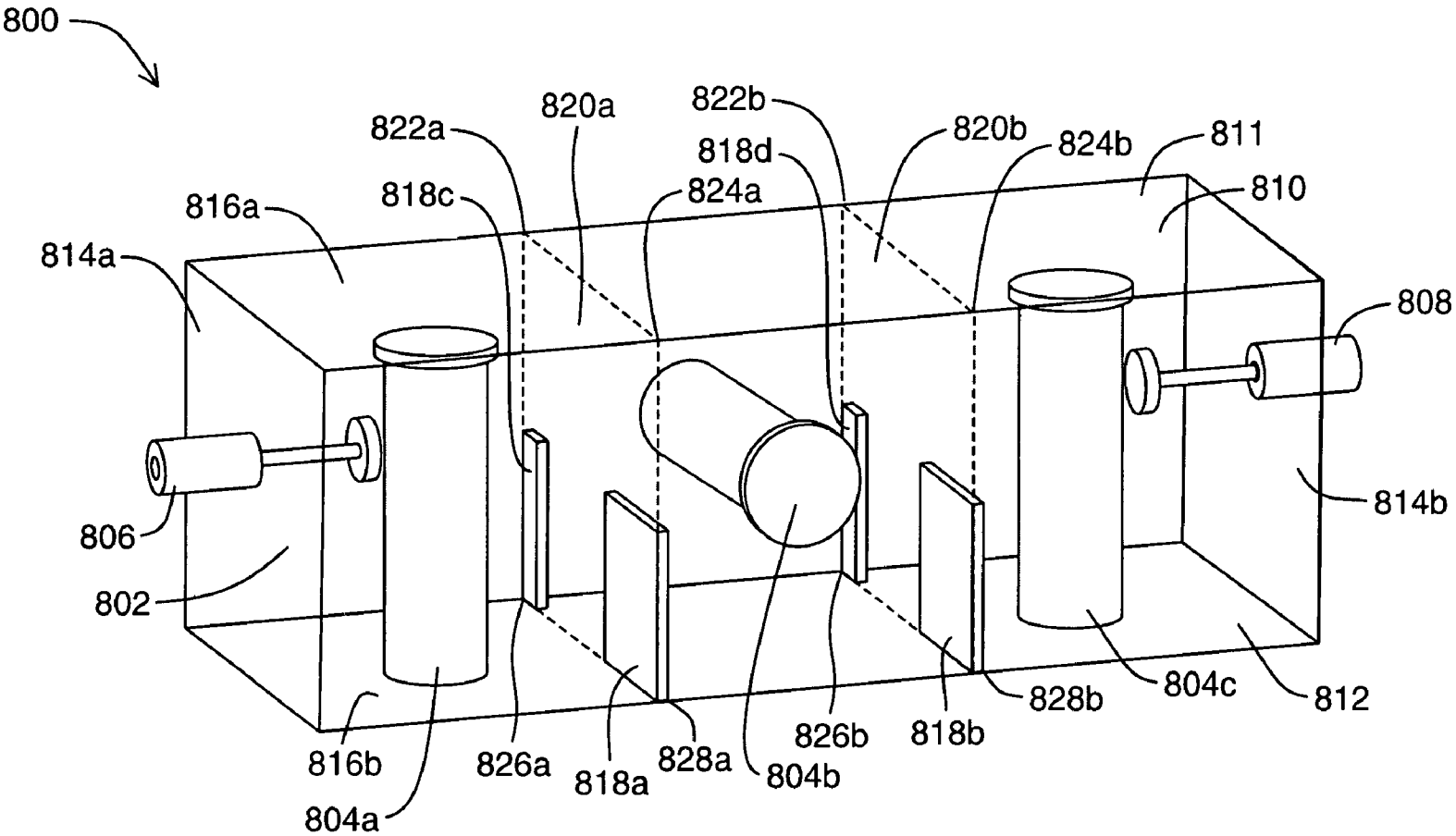
FIG. 8A is a perspective view of a bandpass filter in accordance with at least one embodiment.
Figure 8B:
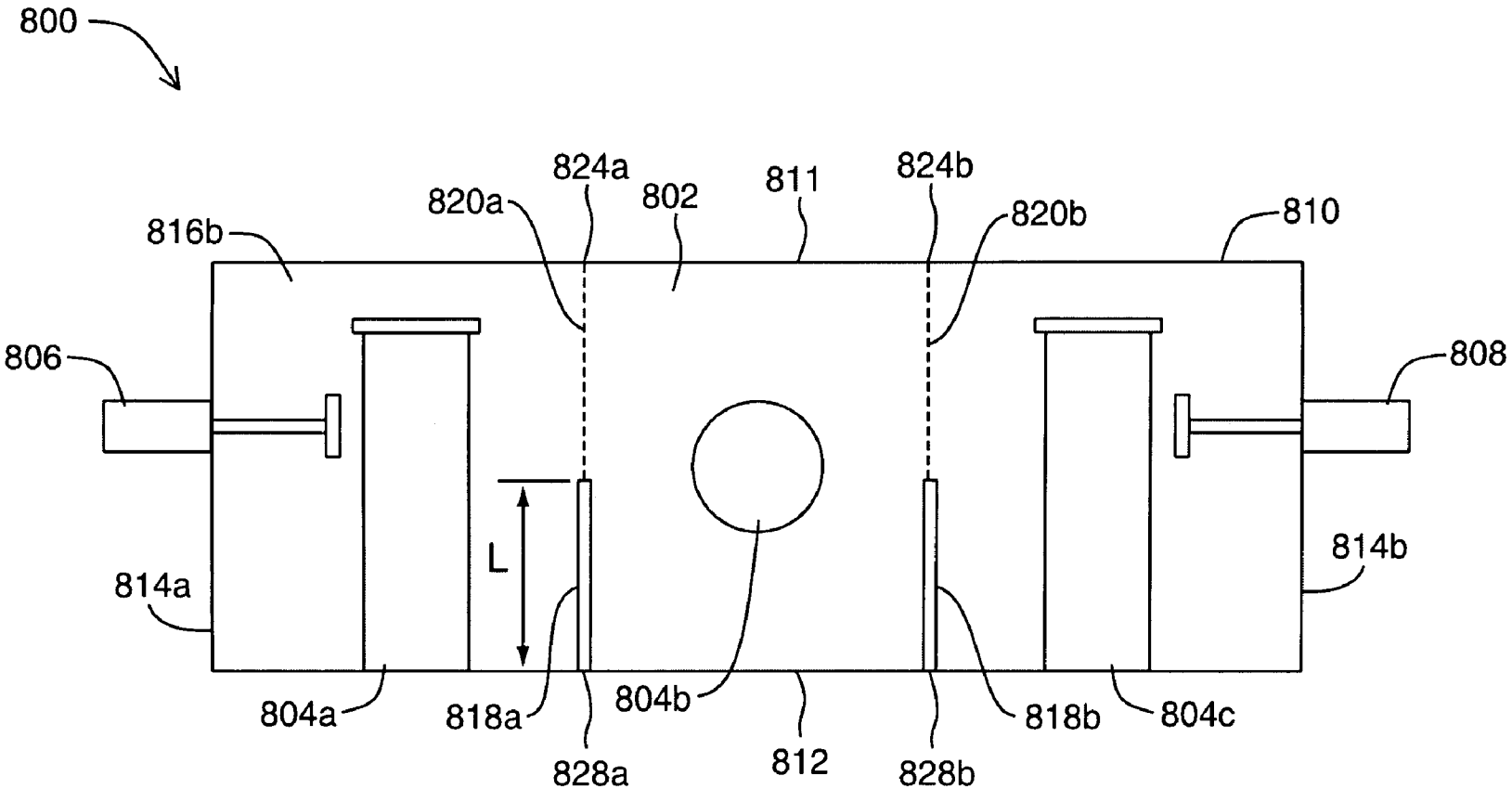
FIG. 8B is a side view of the bandpass filter of FIG. 8A.
Figure 8C:
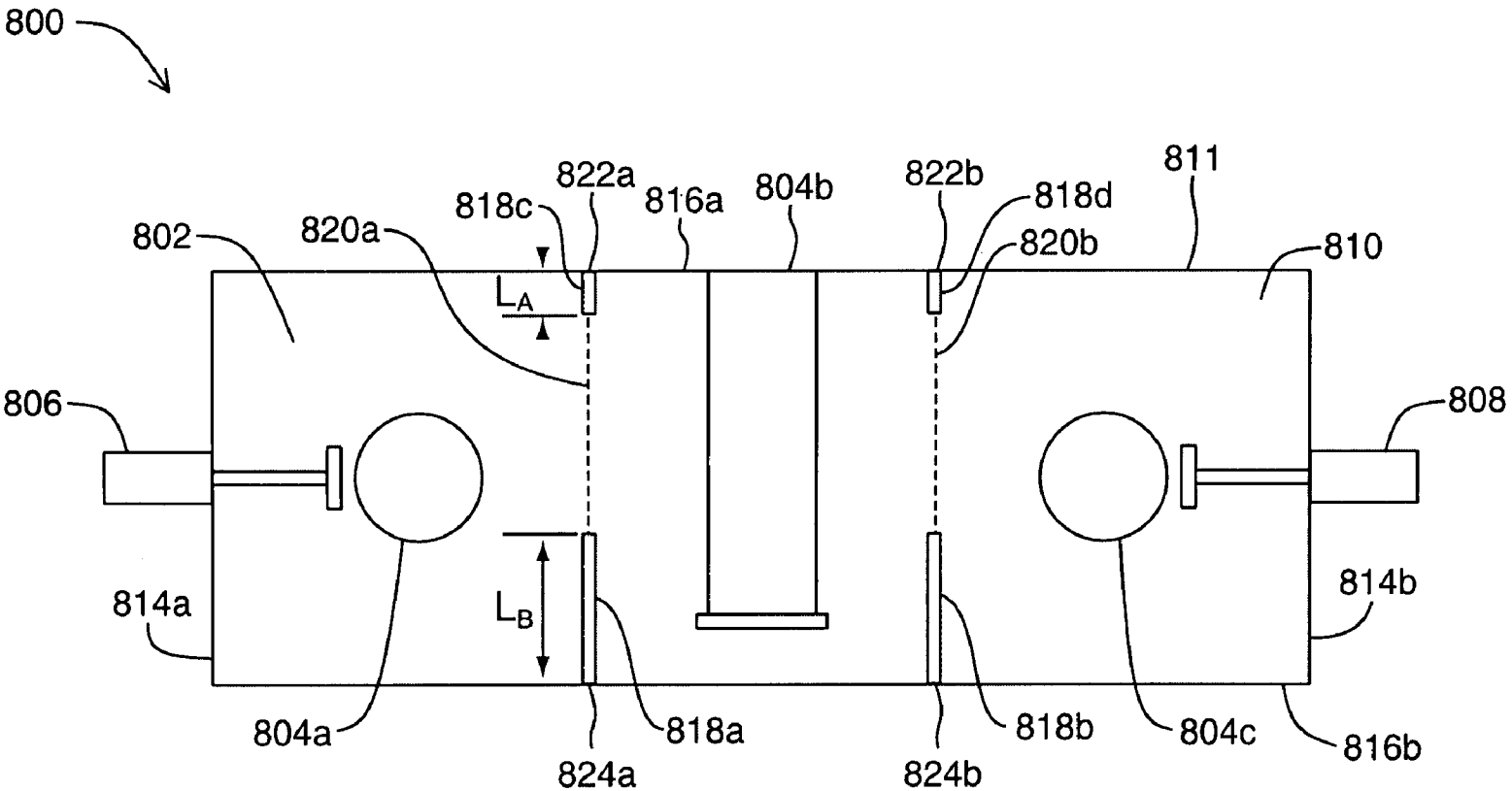
FIG. 8C is a top view of the bandpass filter of FIG. 8A.

When there is more than one plate between a pair of adjacent resonators, the contribution from each plate may add up or cancel depending on the location of this plate. An exemplary filter 800 with multiple plates between adjacent resonators is shown in FIGS. 8A to 8C. FIG. 8A is a perspective view of the bandpass filter 800, FIG. 8B is a side view of the bandpass filter 800, and FIG. 8C is a top view of the bandpass filter 800. Bandpass filter 800 has the same configuration as bandpass filter 200 of FIGS. 2A to 2C except that it has four rectangular plates 818*a*, 818*b*, 818*c* and 818*d*, two between each pair of adjacent resonators. Elements of microwave bandpass filter 800 that correspond to microwave bandpass filter 200 of FIGS. 2A to 2C will be identified by similar reference numerals. Generally, corresponding elements will share the same last two digits. For example, the cavity 202 of the filter 200 of FIGS. 2A to 2C corresponds to the cavity 802 of the filter 800 of FIGS. 8A to 8C.

In filter 800, two of the rectangular plates 818*c* and 818*d* are positioned at the lower-left corner 826*a* and 826*b* of the corresponding planes 820*a* and 820*b*, and two of the rectangular plates 818*a* and 818*b* are positioned in the lower-right corner 828*a* and 828*b* of the corresponding planes 820*a* and 820*b*. Each of the plates 818*c* and 818*d* in the lower-left corner 826*a*, 826*b* has a length of $L_A$ and height of L. Each of the plates 818*a* and 818*b* in the lower-right corner 828*a*, 828*b* has a length of $L_B$ and height of L.

Figure 9:
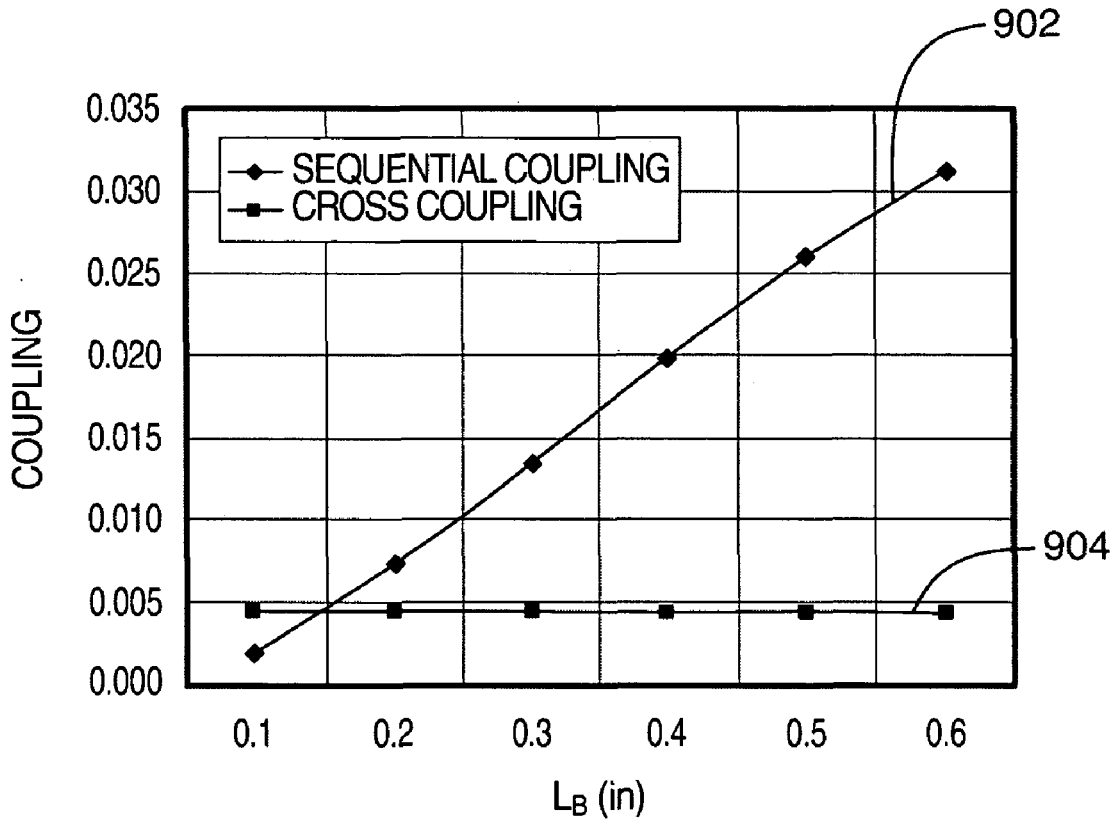
FIG. 9 is a graph of the sequential and cross coupling coefficients for the filter in FIG. 8.

In filter 800, the sequential coupling between adjacent resonators (i.e. between the first and second resonators 804*a* and 804*b*, or between the second and third resonators 804*b* and 804*c*) and cross coupling between the first and third resonators 804*a* and 804*c* is a function of $L_B$ as shown in FIG. 9. Specifically, FIG. 9 illustrates the sequential coupling curve 902 and cross coupling curve 904 of filter 800 where the distance between adjacent resonators d is 1.25 inches and the height L of the plates 818*a*, 818*b*, 818*c* and 818*d* is 0.7 inches. It is assumed that $L_A+L_B=L$ in the example. When $L_A$ reduces to 0 inches, the filter 800 of FIGS. 8A to 8C and the filter 200 of FIGS. 2A to 2C have the same configuration. The filter 800 of FIGS. 8A to 8C can therefore be considered as the result of splitting the plates 218*a* and 218*b* in FIGS. 2A to 2C into two pieces. As can be seen from curves 902 and 904, the cross coupling remains unchanged and sequential coupling increases when the length $L_B$ of the plates 818*a* and 818*b* in the lower-right corner 828*a*, 828*b* increases. Therefore, by separating the plate into two pieces, the sequential coupling and cross coupling can be controlled independently. In particular, making one piece smaller and the other piece bigger does not change cross coupling, but changes sequential coupling significantly.

Using the configurations described herein, a filter may be designed following these general steps. First, in order to realize the coupling values that can meet the desired filter performance, the initial values for resonator distance, position and sizes of the coupling plate(s) are estimated using the curves shown in FIGS. 5A, 5B, 5C, 6 and 7 through interpolation. Understandably, if the filter center frequency, cavity size, or resonator sizes are different from the examples herein, new curves of sequential and cross coupling values need to be calculated. These initial dimensions are then optimized using conventional methods to meet the desired filter performance.

Alternatively, the size of the plate(s) can be selected to realize the required cross coupling value using FIG. 6 or FIG. 7 as if a single plate is to be used. Then, it is decided how the plate can be split to realize the desired sequential coupling through direct calculation of the sequential coupling or data curves similar to FIG. 9. These initial dimensions are then optimized using conventional methods to meet the desired filter performance. Using multiple coupling plates between adjacent resonators offers additional design flexibility.

To more clearly demonstrate how the orientation of the resonators, plate positions, plate sizes, and distance between resonators can be used to achieve filters with desired frequency responses, five exemplary filters designed in accordance with the principles described herein will be discussed. For ease of comparison, each of the four filters described below have been designed to have a center frequency of 1.54 GHz and a bandwidth of 48.8 MHz. In addition, in each of the five exemplary filters described below, the cavity width a is 1.5 inches, the cavity height b is 1.5 inches, the thickness of each plate is 0.04 inches, the diameter of each resonator is 0.4 inches, and the height of each resonator is 1.3 inches.

The first exemplary filter is the filter 200 of FIGS. 2A to 2C where the distance between adjacent resonators is 1.3 inches; the length and height of the plates 218*a* and 218*b* is 0.6 inches; the distance between the first resonator 204*a* and the first end wall 214*a* is 0.75 inches; and the distance between the third resonator 204*c* and the second end wall 214*b* is 0.75 inches.

The second exemplary filter is the filter 800 of FIGS. 8A to 8C where the distance between adjacent resonators is 1.25 inches, the height of the plates 818*a*, 818*b*, 818*c* and 818*d* is 0.7 inches; the length of the plates 818*c* and 818*d* is 0.15 inches; the length of the plates 818*a* and 818*b* is 0.55 inches; the distance between the first resonator 804*a* and the first end wall 814*a* is 0.75 inches; and the distance between the third resonator 804*c* and the second end wall 814*b* is 0.75 inches.

Figure 10:
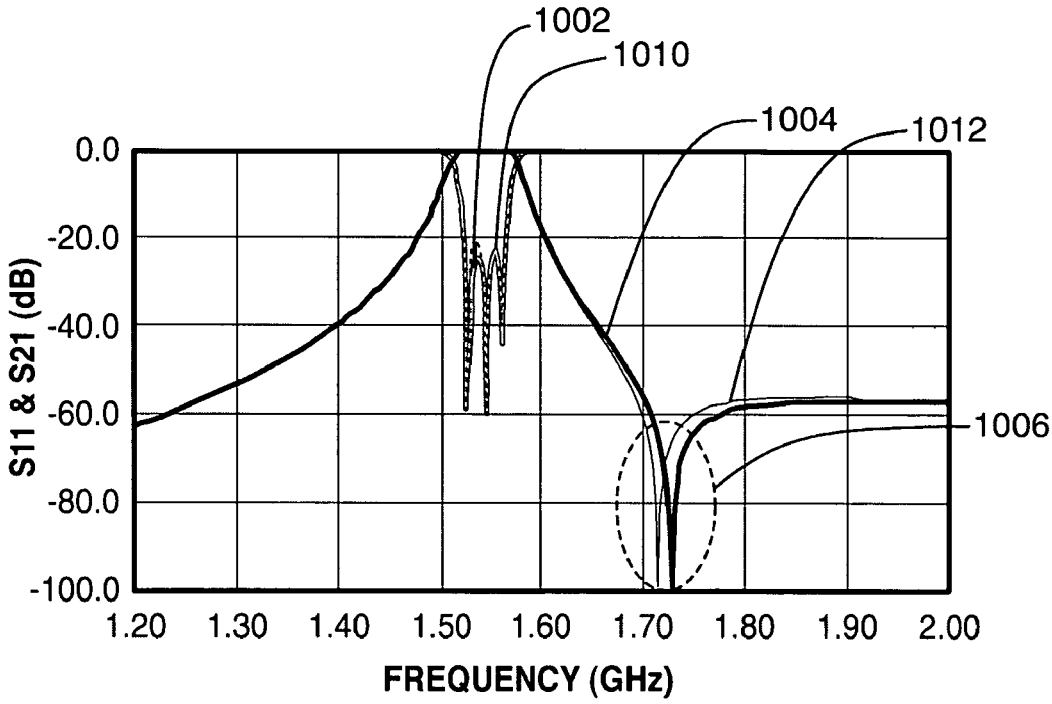
FIG. 10 is the frequency responses of the bandpass filters of FIG. 2A and FIG. 8A.

Reference is now made to FIG. 10, which illustrates the frequency response of both the first and the second exemplary filters. Specifically, FIG. 10 illustrates the simulated $S_{11}$ and $S_{21}$ scattering parameter ("s-parameter") curves 1002 and 1004 for the first exemplary filter, and the simulated $S_{11}$ and $S_{21}$ s-parameter curves 1010 and 1012 for the second exemplary filter. It can be seen from the $S_{11}$ and $S_{21}$ curves 1002 and 1004 that the first exemplary filter is a three pole filter with a transmission zero 1006 in the upper stop band. As described above, the transmission zero 1006 is generated by the cross coupling between the first and third resonators 204*a* and 204*c*. It can be seen from the $S_{11}$ and $S_{21}$ curves 1010 and 1012 that the second exemplary filter realizes the same sequential and cross coupling values as the first exemplary filter using multiple plates between adjacent resonators.

Figure 11A:
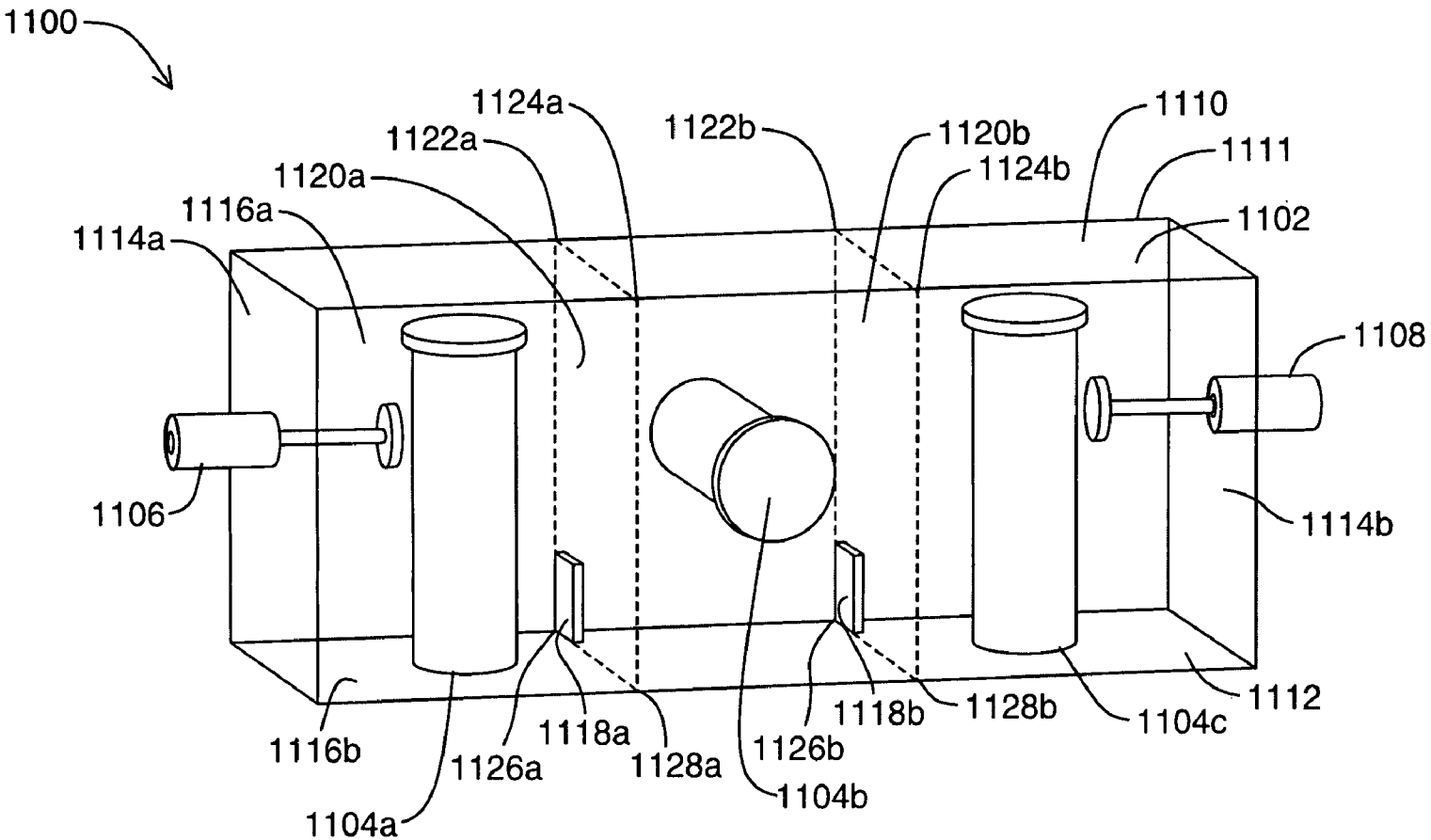
FIG. 11A is a perspective view of a bandpass filter in accordance with at least one embodiment.
Figure 11B:
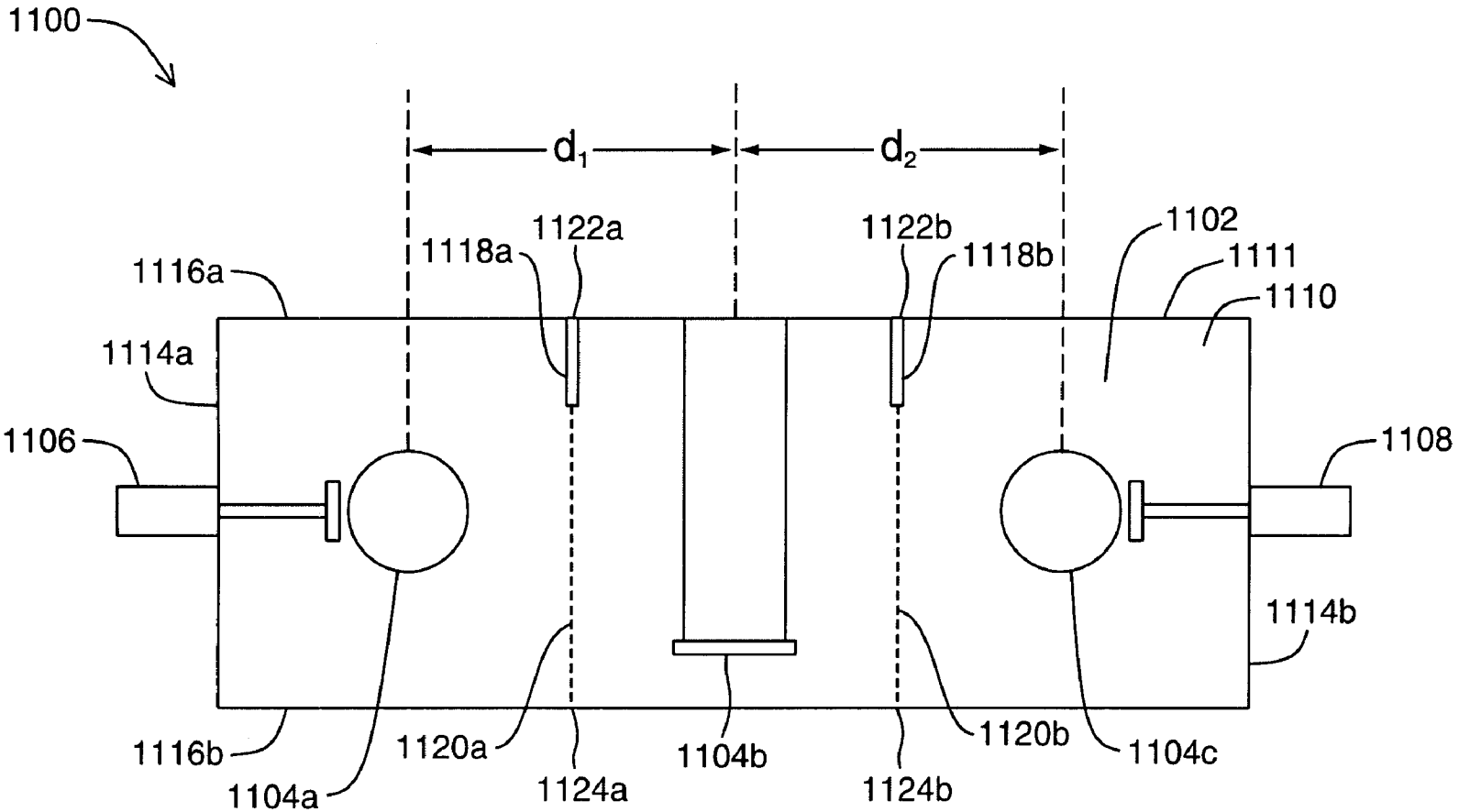
FIG. 11B is a top view of the bandpass filter of FIG. 11A.

The third exemplary filter is filter 1100 illustrated in FIGS. 11A and 11B where the distance between adjacent resonators is 1.1 inches; the plates 1118*a* and 1118*b* have a length and height of 0.3 inches; the distance between the first resonator 1104*a* and the first end wall 1114*a* is 0.75 inches; and the distance between the third resonator 1104*c* and the second end wall 1114*b* is 0.75 inches. FIG. 11A is a perspective view of the bandpass filter 1100, and FIG. 11B is a top view of the bandpass filter 1100. Bandpass filter 1100 has the same configuration as bandpass filter 200 of FIGS. 2A to 2C except that the plates 1118*a* and 1118*b* are positioned in different corners of the planes 1120*a* and 1120*b*. Specifically, the first and second plates 1118*a* and 1118*b* are placed in the lower-left corners 1126*a* and 1126*b* of the first and second planes 1120*a* and 1120*b* respectively. Elements of microwave bandpass filter 1100 that correspond to microwave bandpass filter 200 of FIGS. 2A to 2C will be identified by similar reference numerals. Generally, corresponding elements will share the same last two digits. For example, the cavity 202 of the filter 200 of FIGS. 2A to 2C corresponds to the cavity 1102 of the filter 1100 of FIGS. 11A and 11B.

Figure 12:
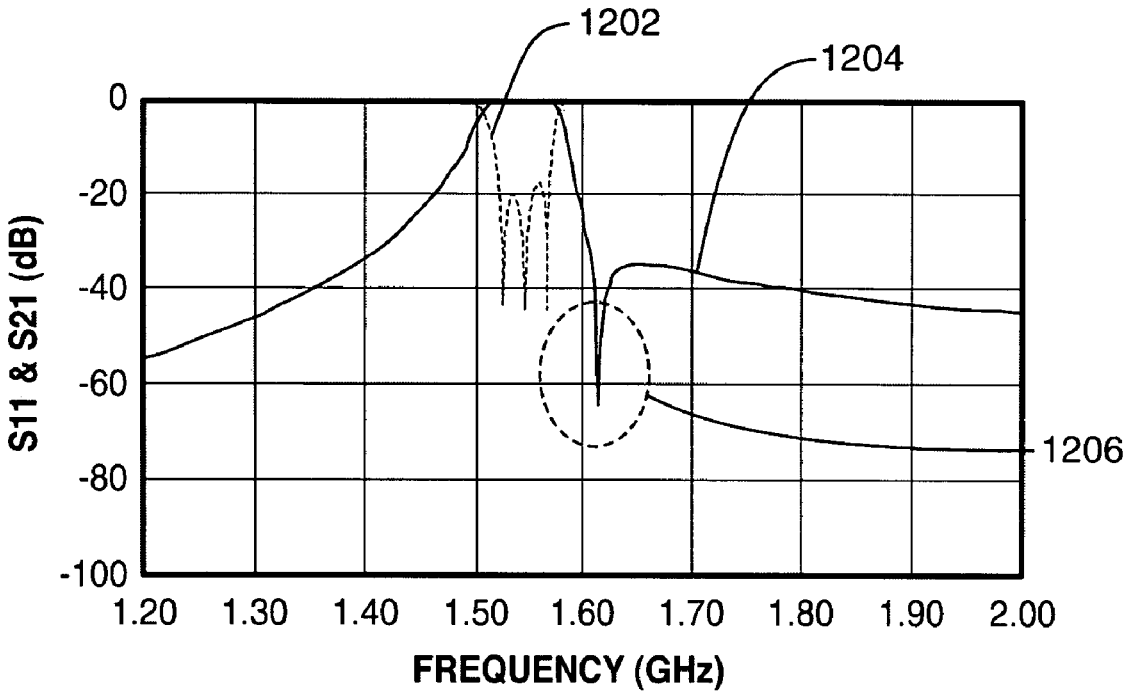
FIG. 12 is the frequency response of the bandpass filter of FIG. 11A.

Reference is now made to FIG. 12, which illustrates the frequency response of the third exemplary filter. Specifically, FIG. 12 illustrates the simulated $S_{11}$ and $S_{21}$ scattering parameter ("s-parameter") curves 1202 and 1204 for the third exemplary filter. By decreasing the distance between adjacent resonators from 1.3 inches to 1.1 inches, the cross coupling of the third exemplary filter is increased over the first exemplary filter. However, decreasing the distance between the resonators also increases the sequential coupling. To compensate for the increase in the sequential coupling caused by the reduced distance between the resonators, the plates 1118*a* and 1118*b* are moved from the lower-right corner 1128*a*, 1128*b* to the lower-left corner 1126*a*, 1126*b*. As illustrated in FIGS. 5A and 5B, this has the effect of reducing the sequential coupling while maintaining the same cross coupling. We can see from curves 1202 and 1204 of FIG. 12 that the third exemplary filter is also a three-pole filter with a transmission zero 1206 in the upper stop band. The third exemplary filter, however, achieves the same bandwidth as the first exemplary filter using a different resonator distance, plate size and plate location, resulting in a different out-of-band rejection level. Specifically, as can be seen from FIG. 12, the transmission zero 1206 of FIG. 12 is closer to the passband than the transmission zero 1006 of FIG. 10.

The fourth exemplary filter is the bandpass filter 1300 of FIGS. 13A to 13C where the distance between adjacent resonators is 1.27 inches; the length and height of the plates 1318*a* and 1318*b* is 0.6 inches; the distance between the first resonator 1304*a* and the first end wall 1314*a* is 0.75 inches; and the distance between the third resonator 1304*c* and the second end wall 1314*b* is 0.75 inches. FIG. 13A is a perspective view of the bandpass filter 1300, FIG. 13B is a side view of the bandpass filter 1300, and FIG. 13C is a top view of the bandpass filter 1300. Bandpass filter 1300 has the same configuration as the bandpass filter 200 of FIGS. 2A to 2C except the third resonator 1304*c* is rotated 180 degrees from the first resonator 1304*a*. In addition, the plates 1318*a* and 1318*b* are positioned in different corners of the planes 1320*a* and 1320*b*. Specifically, the first plate 1318*a* is positioned in the lower-right corner 1328*a* of the first plane 1320*a*, and the second plate 1318*b* is positioned in the upper-right corner 1324*b* of the second plane 1320*b*. Elements of microwave bandpass filter 1300 that correspond to microwave bandpass filter 200 will be identified by similar reference numerals. Generally, corresponding elements will share the same last two digits. For example, the cavity 202 of the filter 200 of FIGS. 2A to 2C corresponds to the cavity 1302 of the filter 1300 of FIGS. 13A to 13C.

In filter 1300 of FIGS. 13A to 13C, both the second and third resonators 1304*b* and 1304*c* have a different spatial orientation than the first resonator 1304*a*. Similar to the filter 200 of FIGS. 2A to 2C, the second resonator 1304*b* is rotated 90 degrees with respect to the first resonator 1304*a* so that the first resonator 1304*a* is substantially vertical and the second resonator 1304*b* is substantially vertical. However, unlike the filter 200 of FIGS. 2A to 2C, the third resonator 1304*c* is also rotated with respect to the first resonator 1304*a*. Specifically, the third resonator 1304*c* is rotated 180 degrees with respect to the first resonator 1304*a* so that the third resonator 1304*c* is upside down with respect to the first resonator 1304*a*. As described above, this results in cross coupling between the first and third resonators 1304*a* and 1304*c* that produces a transmission zero in the lower stop band of the frequency response of the filter.

Similar to filter 200, the first plate 1318*a* of filter 1300 is positioned in the lower-right corner 1328*a* of the first plane 1320*a*. However, unlike filter 200, the second plate 1318*b* of filter 1300 is positioned in the upper-right corner 1324*b* of the second plane 1320*b*. It should be noted that because of the orientation of the second and third resonators 1304*b* and 1304*c* the second plate 1318*b* of filter 1300 (although situated in a different corner) will have the same effect on the second and third resonators 1304*b* and 1304*c* of filter 1300 as the second plate 218*b* will have on the second and third resonators 204*b* and 204*c* of filter 200. This is because both the second plate 1318*b* of filter 1300 and the second plate 218*b* of filter 200 are situated in the corner that is closest to the top of the corresponding second resonator 204*b*, 1304*b* and the bottom of the corresponding third resonator 204*c*, 1304*c*.

Figure 14:
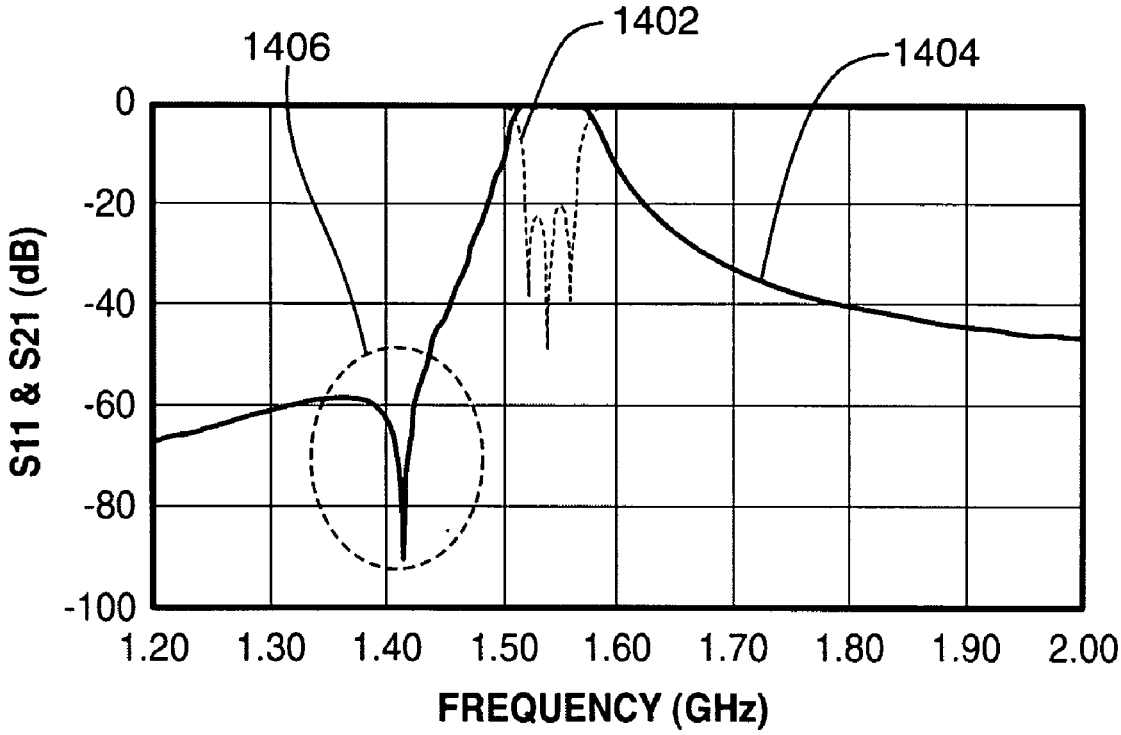
FIG. 14 is the frequency response of the bandpass filter of FIG. 13A.

Reference is now made to FIG. 14, which illustrates the frequency response of the fourth exemplary filter. Specifically, FIG. 14 illustrates the simulated $S_{11}$ and $S_{21}$ scattering parameter ("s-parameter") curves 1402 and 1404 for the fourth exemplary filter. It can be seen from the s-parameter curves 1402 and 1404 that the fourth exemplary filter is a three-pole filter with a transmission zero 1406 below its passband.

Figure 15:
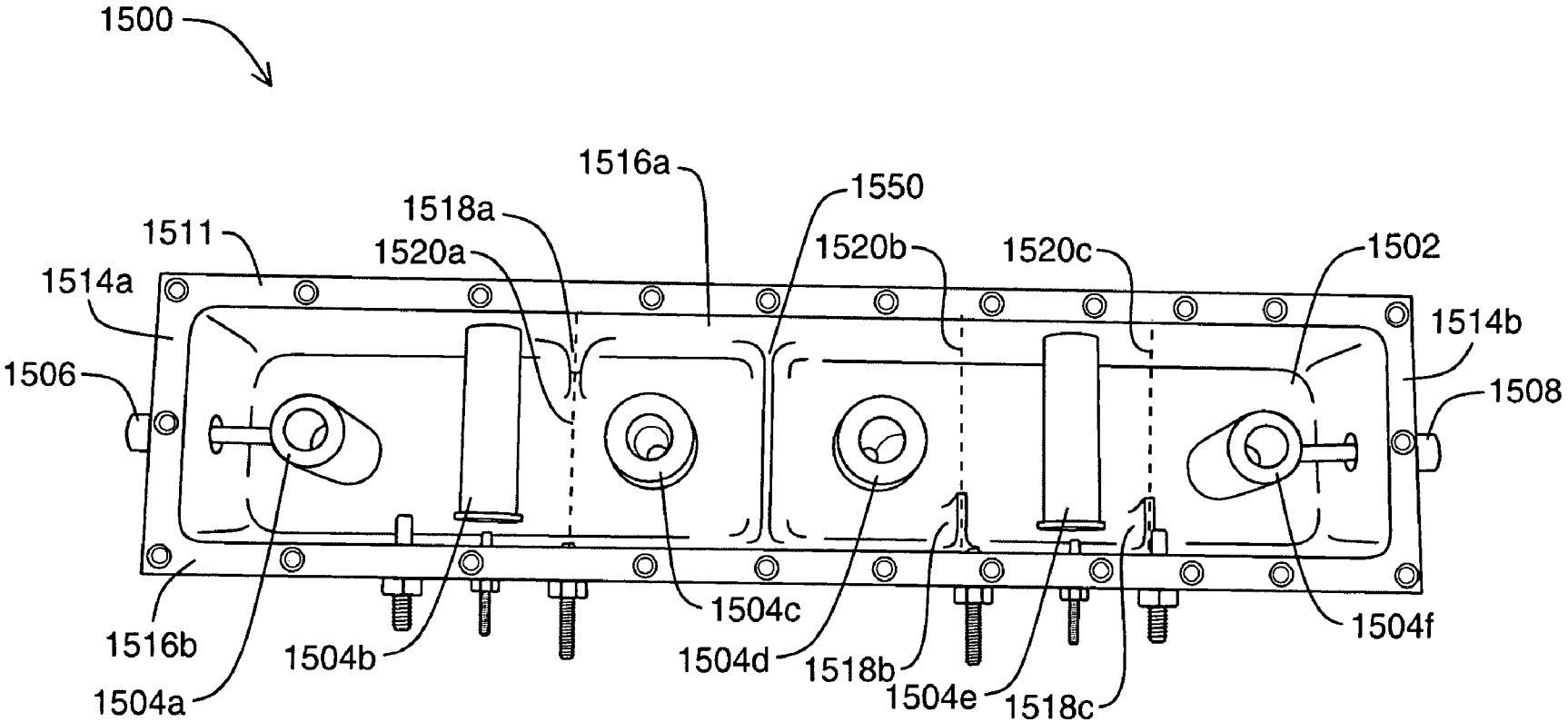
FIG. 15 is a top view of a bandpass filter in accordance with at least one embodiment.

The fifth exemplary filter is the bandpass filter 1500 of FIG. 15 where the distance between resonators is 1.12 inches between the first and second resonators 1504*a* and 1504*b*, 1.1 inches between the second and third resonators 1504*b* and 1504*c*, 1.5 inches between the third and fourth resonators 1504*c* and 1504*d*, 1.35 inches between the fourth and fifth resonators 1504*d* and 1504*e*, 1.2 inches between the fifth and sixth resonators 1504*e* and 1504*f*; and the first plate 1518*a* has a length and height of 0.48 inches, the second plate 1518*b* has a length and height of 0.38 inches, and the third plate 1518*c* has a length and height of 0.475 inches. The distance between the first resonator 1504*a* and the first end wall 1514*a* is 0.75 inches. The distance between the sixth resonator 1504*f* and the second end wall 1514*b* is 0.75 inches.

Bandpass filter 1500 has the same configuration as the bandpass filter 200 of FIGS. 2A to 2C except it includes three additional resonators 1504*d*, 1504*e* and 1504*f*. The fourth and sixth resonators 1504*d* and 1504*f*, similar to the first and third resonators 1504*a* and 1504*c*, have a substantially vertical orientation, and the fifth resonator 1504*e*, similar to the second resonator 1504*b*, has a substantially horizontal orientation. Accordingly, filter 1500 will have two transmission zeros in the upper stop band. The first transmission zero is produced by the cross coupling between the first and third resonators 1504*a* and 1504*c*, and the second transmission zero is produced by the cross coupling between the fourth and sixth resonators 1504*d* and 1504*f*.

In addition, bandpass filter 1500 has a different configuration of plates over filter 200. Specifically, bandpass filter 1500 has three plates 1518*a*, 1518*b*, and 1518*c*. The first plate 1518*a* is situated between the second and third resonators 1504*b* and 1504*c* in the lower-left corner of the first plane 1520*a*. The second plate 1518*b* is situated between the fourth and fifth resonators 1504*d* and 1504*e* in the lower-right corner of the second plane 1520*b*. The third plate 1518*c* is situated between the fifth and sixth resonators 1504*e* and 1504*f* in the lower-right corner of the third plane 1520*c*. Bandpass filter 1500 also has a metal wall 1550 between the third and fourth resonators 1504*c* and 1504*d*. Such wall is a well-known conventional way of controlling the sequential coupling between the third and the fourth resonators 1504*c* and 1504*d*. In the fifth exemplary filter the wall 1550 has a height of 0.815 inches.

Elements of microwave bandpass filter 1500 that correspond to microwave bandpass filter 200 are identified by similar reference numerals. Generally, corresponding elements will share the same last two digits. For example, the cavity 202 of the filter 200 of FIGS. 2A to 2C corresponds to the cavity 1502 of the filter 1500 of FIG. 15.

Figure 16:
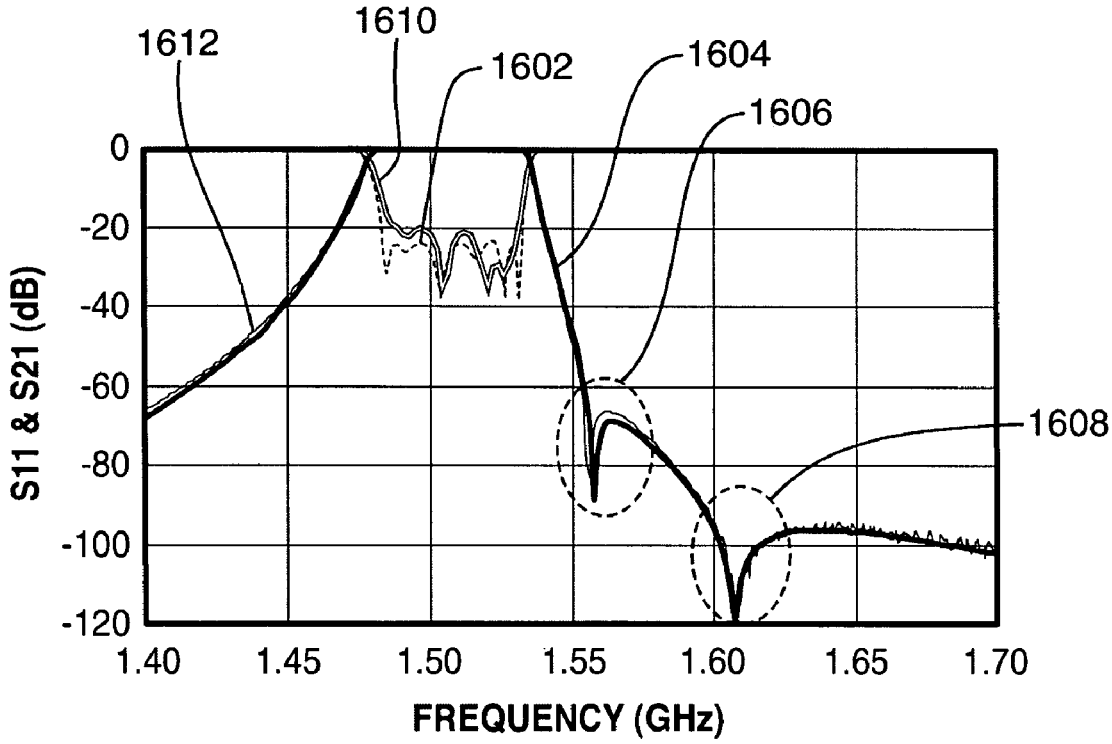
FIG. 16 is the frequency response of the bandpass filter of FIG. 15.

Reference is now made to FIG. 16, which illustrates the frequency response of the fifth exemplary filter. Specifically, FIG. 16 illustrates the measured $S_{11}$ and $S_{21}$ scattering parameter ("s-parameter") curves 1602 and 1604 and the simulated $S_{11}$ and $S_{21}$ curves 1610 and 1612 for the fifth exemplary filter. It can be seen from the s-parameter curves 1602, 1604, 1610 and 1612 that the fifth exemplary filter is a six-pole filter with two transmission zeros 1606 and 1608 in the upper stop band.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A microwave bandpass filter comprising:

a cavity defined by a tubular structure and two opposing end walls, the tubular structure having a first end and a second end, one of the opposing end walls being attached to the first end and the other of the opposing end walls being attached to the second end;

at least three resonators arranged in a row in the cavity, connected by apertures, wherein at least one resonator has a different spatial orientation from at least one other resonator;

an input connector coupled to a first resonator of the at least three resonators;

an output connector coupled to a second resonator of the at least three resonators; and at least one plate positioned between a pair of adjacent resonators for realizing sequential coupling between the pair of adjacent resonators and cross coupling between at least one pair of non-adjacent resonators.

2. The microwave bandpass filter of claim 1, wherein the filter has a frequency response comprising a passband, a lower stop band and a higher stop band, and the cross coupling produces at least one transmission zero in at least one of the lower stop band and the higher stop band.

3. The microwave bandpass filter of claim 1, wherein the sequential coupling is associated with a sequential coupling value, and the sequential coupling value is based on the position and the size of the at least one plate and distance between resonators.

4. The microwave bandpass filter of claim 3, wherein the cross coupling is associated with a cross coupling value and the cross coupling value is based on the size of the plate and distance between resonators.

5. The microwave bandpass filter of claim 4, further comprising a plurality of planes parallel to the end walls, each plane situated between a pair of adjacent resonators and defined by an upper-left corner, an upper-right corner, a lower-left corner and a lower-right corner, wherein the at least one plate is positioned at least one of the upper-left corner, the upper-right corner, the lower-left corner and the lower-right corner of one plane of the plurality of planes.

6. The microwave bandpass filter of claim 5, wherein at least one of the upper-right corner, the upper-left corner, the lower-right corner and the lower-left corner of the one plane is a sequential coupling value increase position;

at least one of the upper-right corner, the upper-left corner, the lower-right corner and the lower-left corner of the one plane is a sequential coupling value decrease position; and when the at least one plate is in the increase position, an increase in the size of the at least one plate results in an increase in the sequential coupling value for the pair of adjacent resonators; and when the at least one plate is in the decrease position, an increase in the size of the at least one plate results in a decrease in the sequential coupling value for the pair of adjacent resonators.

7. The microwave bandpass filter of claim 1, wherein the at least one plate is one of square shaped and rectangular shaped.

8. The microwave bandpass filter of claim 1, further comprising at least one tuning element mounted to the tubular structure for adjusting the sequential coupling between a pair of adjacent resonators.

9. The microwave bandpass filter of claim 1, further comprising at least one tuning element mounted to the tubular structure for adjusting the cross coupling between a pair of non-adjacent resonators, wherein the at least one tuning element is situated between the pair of non-adjacent resonators.

10. The microwave bandpass filter of claim 1, wherein the filter is free of physical cross coupling means.

11. The microwave bandpass filter of claim 1, wherein the at least one resonator has a substantially horizontal orientation and the at least one other resonator has a substantially vertical orientation.

12. The microwave bandpass filter of claim 2, wherein the at least one resonator is rotated substantially 90 degrees with respect to the at least one other resonator.

13. The microwave bandpass filter of claim 2, wherein at least one resonator is rotated substantially 180 degrees with respect to the at least one other resonator.

14. The microwave bandpass filter of claim 1, wherein each of the resonators is a coaxial resonator with one of a rectangular cross section and a square cross section.

15. The microwave bandpass filter of claim 1, further comprising a plurality of plates positioned between the pair of adjacent resonators, and wherein the relative sizing of the plurality of plates realizes the sequential coupling essentially independently of the cross coupling.

16. The microwave bandpass filter of claim 1, wherein the at least one plate comprising two plates positioned between the pair of adjacent resonators, and wherein the relative sizing of the two plates realizes the sequential coupling essentially independently of the cross coupling.

* * * * *